US012735820B2

(12) United States Patent
Suzuki et al.

(10) Patent No.: US 12,735,820 B2
(45) Date of Patent: Sep. 15, 2026

(54) SEWING MACHINE

(71) Applicant: BROTHER KOGYO KABUSHIKI KAISHA, Nagoya (JP)

(72) Inventors: Yasunori Suzuki, Nagoya (JP); Kentaro Torii, Nagoya (JP); Shinya Fujihara, Obu (JP); Yoshihiro Minematsu, Nagoya (JP); Masashi Tokura, Nagoya (JP); Kazuki Kurokawa, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 19/274,082

(22) Filed: Jul. 18, 2025

(65) Prior Publication Data

US 2026/0043179 A1 Feb. 12, 2026

(30) Foreign Application Priority Data

Aug. 9, 2024 (JP) ..... 2024-134397

(51) Int. Cl.
*D05B 47/04* (2006.01)
*D05B 69/24* (2006.01)

(52) U.S. Cl.
CPC ..... *D05B 47/04* (2013.01); *D05B 69/24* (2013.01)

(58) Field of Classification Search
CPC ..... D05B 47/04; D05B 69/24; D05B 19/16; D05B 21/00
See application file for complete search history.

(56) References Cited

U.S. PATENT DOCUMENTS

| | | | | |
|---|---|---|---|---|
| 5,022,335 | A * | 6/1991 | Hanyu | D05B 45/00 112/475.05 |
| 5,826,526 | A | 10/1998 | Tomita | |
| 2007/0272136 | A1* | 11/2007 | Shimizu | D05B 11/00 112/2 |
| 2012/0006241 | A1* | 1/2012 | Nishiyama | D05B 55/14 112/221 |
| 2014/0116310 | A1 | 5/2014 | Naka | |
| 2014/0238286 | A1* | 8/2014 | Kawai | D05B 47/04 112/238 |
| 2017/0073864 | A1* | 3/2017 | Nakajima | D05B 69/00 |

FOREIGN PATENT DOCUMENTS

| | | | |
|---|---|---|---|
| JP | H10-146481 | A | 6/1998 |
| JP | 2014-087441 | A | 5/2014 |

* cited by examiner

*Primary Examiner* — Patrick J. Lynch
(74) *Attorney, Agent, or Firm* — Oliff PLC

(57) ABSTRACT

A controller performs a free motion sewing operation of driving a sewing machine motor to move a needle bar up and down in a state where an upper end of a feed dog is located below a needle plate. The controller performs a thread tension control operation of, while performing the free motion sewing operation, controlling an actuator to adjust a length of a spring during a first period to a first length and to adjust the length of the spring during a second period to a second length shorter than the first length. The first period is at least part of a needle up period in which a lower end of a sewing needle is located above the needle plate. The second period includes at least part of a needle down period in which the lower end of the sewing needle is located below the needle plate.

13 Claims, 12 Drawing Sheets

SEWING MACHINE

REFERENCE TO RELATED APPLICATIONS

This application claims priority from Japanese Patent Application No. 2024-134397 filed on Aug. 9, 2024. The entire content of the priority application is incorporated herein by reference.

BACKGROUND ART

A sewing machine configured to perform free motion sewing is known.

SUMMARY

In free motion sewing, a sewing operation is performed while freely moving a sewing workpiece with a user's hand in a state where a feed dog is set to a drop feed in which the feed dog does not protrude from an upper surface of a bed.

In free motion sewing, it may be difficult for a user to manually move a sewing workpiece due to resistance applied from a thread when the sewing workpiece is moved. For example, when free motion sewing is performed, the thread extending from the stitch pulls the sewing workpiece to a considerable extent, and thus, there is a possibility that resistance is applied to the movement of the sewing workpiece.

In view of the foregoing, an example of an object of this disclosure is to provide a sewing machine that contributes to improving the maneuverability (that is, ease of movement) of a sewing workpiece when a user manually moves the sewing workpiece in a case where free motion sewing is performed.

According to a first aspect, this specification discloses a sewing machine. The sewing machine includes a needle plate, a feed dog, a needle bar, a sewing machine motor, a thread tension disc, a spring, an actuator, and a controller. A sewing needle is attachable to the needle bar. The sewing machine motor is configured to drive the needle bar to move up and down. The spring is configured to urge the thread tension disc to apply a thread tension pressure to the thread tension disc. The actuator is configured to adjust a length of the spring. The controller is configured to perform a free motion sewing operation of driving the sewing machine motor to move the needle bar up and down in a state where an upper end of the feed dog is located below the needle plate. The controller is configured to perform a thread tension control operation of, while performing the free motion sewing operation, controlling the actuator to adjust the length of the spring during a first period to a first length and to adjust the length of the spring during a second period to a second length shorter than the first length. Thus, the length of the spring is the first length during the first period, and is the second length during the second period. The first period is at least part of a needle up period in which a lower end of the sewing needle is located above the needle plate. The second period includes at least part of a needle down period in which the lower end of the sewing needle is located below the needle plate.

The thread tension control operation performed by the controller of the sewing machine of the first aspect adjusts the length of the spring such that the second length is shorter than the first length. That is, the spring is compressed, and thus the thread tension pressure during the second period is higher than the thread tension pressure during the first period. The thread tension disc transmits a thread tension pressure to an upper thread, and the tension applied to the upper thread is adjusted. Thus, the tension applied to the upper thread during the first period is smaller than the tension applied to the upper thread during the second period. The first period is a period in which the user may manually move the sewing workpiece in the free motion sewing operation. Thus, the thread tension control operation contributes to improving the maneuverability of the sewing workpiece when the user manually moves the sewing workpiece.

According to a second aspect, this specification discloses a sewing machine. The sewing machine includes a needle plate, a feed dog, a needle bar, a sewing machine motor, an actuator, and a controller. The actuator is configured to adjust a thread tension pressure for adjusting a tension applied to an upper thread. The controller is configured to perform a free motion sewing operation of driving the sewing machine motor to move the needle bar up and down in a state where an upper end of the feed dog is located below the needle plate. The controller is configured to perform a thread tension control operation of, while performing the free motion sewing operation, controlling the actuator to adjust the thread tension pressure during a first period to a first pressure and to adjust the thread tension pressure during a second period to a second pressure higher than the first pressure.

In the thread tension control operation performed by the controller of the sewing machine of the second aspect, the thread tension pressure is adjusted such that the second pressure is higher than the first pressure. Thus, the tension applied to the upper thread by the thread tension pressure is adjusted. Thus, the tension applied to the upper thread during the first period is smaller than the tension applied to the upper thread during the second period. The first period is a period in which the user may manually move the sewing workpiece in the free motion sewing operation. Thus, the thread tension control operation contributes to improving the maneuverability of the sewing workpiece when the user manually moves the sewing workpiece.

According to a third aspect, this specification discloses a sewing machine. The sewing machine includes a needle plate, a feed dog, a needle bar, a sewing machine motor, a first thread tension disc, a second thread tension disc, an actuator, and a controller. The actuator is configured to adjust a disc spacing between the first thread tension disc and the second thread tension disc to adjust a tension applied to an upper thread disposed between the first thread tension disc and the second thread tension disc. The controller is configured to perform a free motion sewing operation of driving the sewing machine motor to move the needle bar up and down in a state where an upper end of the feed dog is located below the needle plate. The controller is configured to perform a thread tension control operation of, while performing the free motion sewing operation, controlling the actuator to adjust the disc spacing during a first period to a first spacing and to adjust the disc spacing during a second period to a second spacing smaller than the first spacing.

In the thread tension control operation performed by the controller of the sewing machine of the third aspect, the disc spacing is adjusted such that the first spacing is longer than the second spacing. The upper thread is disposed between the first and second thread tension discs, and the tension applied to the upper thread is adjusted. Thus, the tension applied to the upper thread during the first period is smaller than the tension applied to the upper thread during the second period. The first period is a period in which the user may manually move the sewing workpiece in the free motion sewing operation. Thus, the thread tension control operation contributes to improving the maneuverability of the sewing workpiece when the user manually moves the sewing workpiece.

DESCRIPTION

Figure 1:
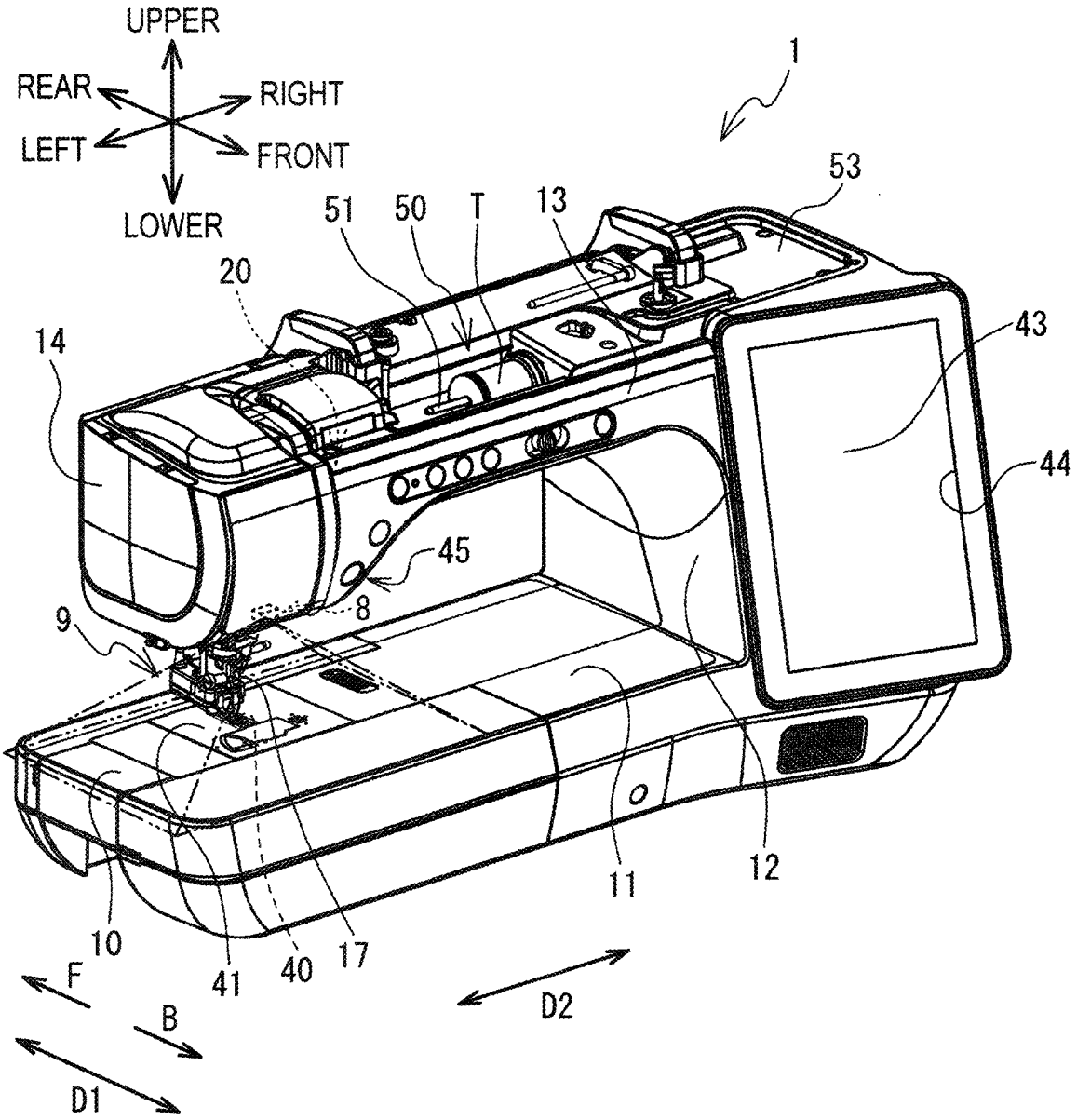
FIG. 1 is a perspective view of a sewing machine 1 to which a movement detector 9 is attached.

An embodiment of the present disclosure will be described with reference to the drawings. The upper-lower direction, the left-lower direction, the right-upper direction, the left-upper direction, and the right-lower direction in FIG. 1 are the upper-lower direction, the leftward direction, the rightward direction, the rearward direction, and the forward direction of a sewing machine 1, respectively. A longitudinal direction D2 of a bed 11 and an arm 13 is the left-right direction of the sewing machine 1. A short direction D1 of the bed 11 and the arm 13 in a horizontal plane is the front-rear direction of the sewing machine 1. In the sewing machine 1, the side on which a pillar 12 is disposed is the right side. The extending direction of the pillar 12 is the upper-lower direction of the sewing machine 1. A direction that is perpendicular to the upper-lower direction and that is from a needle bar 15 toward a presser bar 16 is a rearward direction, and is defined as a forward feed direction F. The direction opposite to the forward feed direction F is forward and is defined as a reverse feed direction B. The forward feed direction F and the reverse feed direction B are directions along the short direction D1.

As shown in FIG. 1, the sewing machine 1 includes the bed 11, the pillar 12, and the arm 13. The pillar 12 extends in the upper-lower direction. The bed 11 has a bed surface 10 and extends leftward from the lower end of the pillar 12. The arm 13 extends leftward from the upper end of the pillar 12 in parallel with the bed 11 above the bed 11. The arm 13 has a head 14 at the left end of the arm 13.

The bed surface 10 extends horizontally. The bed surface 10 includes a needle plate 41 extending horizontally. The needle plate 41 is formed with a needle hole 40 through which a sewing needle 17 attached to the needle bar 15 is inserted. The bed 11 includes a feed mechanism 31 shown in FIG. 7 and a hook mechanism (not shown), for example, below the needle plate 41.

The feed mechanism 31 includes a feed dog 32. The feed mechanism 31 drives the feed dog 32 to move the sewing workpiece in the forward feed direction F or the reverse feed direction B by a particular movement amount. The forward feed direction F corresponds to the direction in which the sewing machine 1 is disposed with respect to the user. The hook mechanism includes a hook. The hook mechanism drives the hook to entangle an upper thread with a lower thread.

As shown in FIG. 1, a liquid crystal display (LCD) 43 and a touch screen 44 that are long in the upper-lower direction are disposed on the front side of the pillar 12. The LCD 43 displays messages used for sewing work, for example. The touch screen 44 is disposed on the front surface of the LCD 43. When the user selects an item displayed on the LCD 43 with a pointing body such as a finger or a dedicated stylus pen described later, the touch screen 44 detects the selected position. The user inputs various instructions to the sewing machine 1 via the touch screen 44.

Figure 4A:
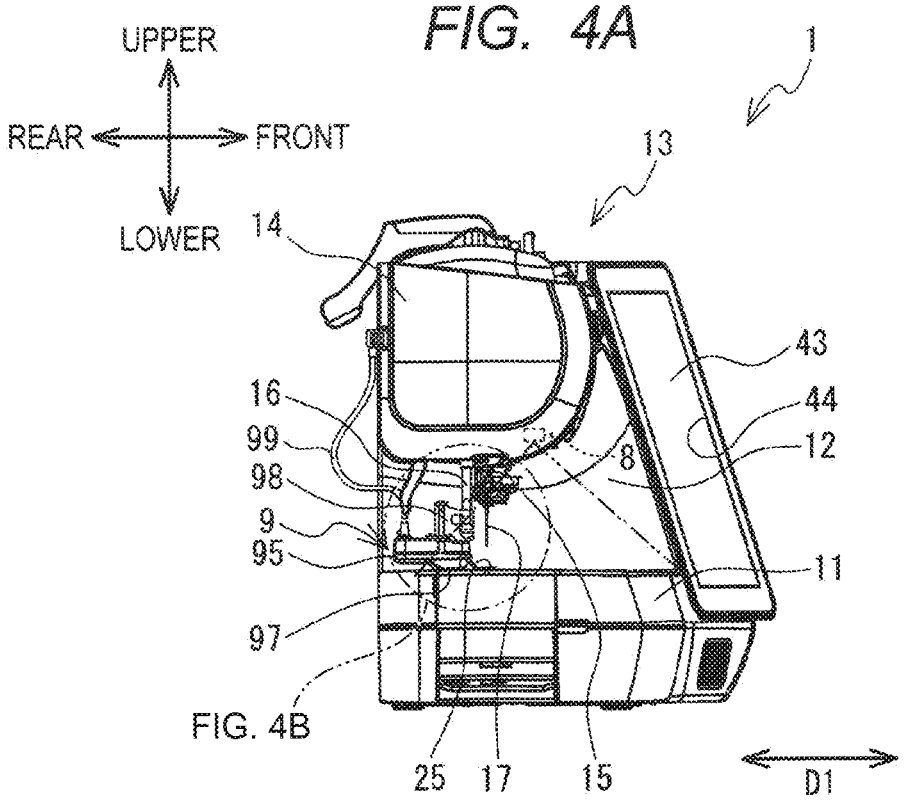
FIG. 4A is a left side view of the sewing machine 1 to which the movement detector 9 is attached.

A plurality of switches including a start-stop switch 45 are disposed on the front surface of the arm 13. The start-stop switch 45 is a switch for instructing the start and stop of a sewing operation. A sewing machine cover configured to open and close (not shown) is disposed on the upper portion of the arm 13. In FIGS. 1 and 4A, the sewing machine cover of the arm 13 is not shown.

A thread storage portion 50 is disposed on an upper surface 53 of the arm 13 that is exposed in a state where the sewing machine cover is opened. The thread storage portion 50 is a recess that is recessed downward and stores a thread spool T around which an upper thread is wound. A thread spool pin 51 extends leftward from the right inner wall surface of the thread storage portion 50. The thread spool T is mounted on the sewing machine 1 by inserting the thread spool pin 51 into an insertion hole of the thread spool T.

Figure 7:
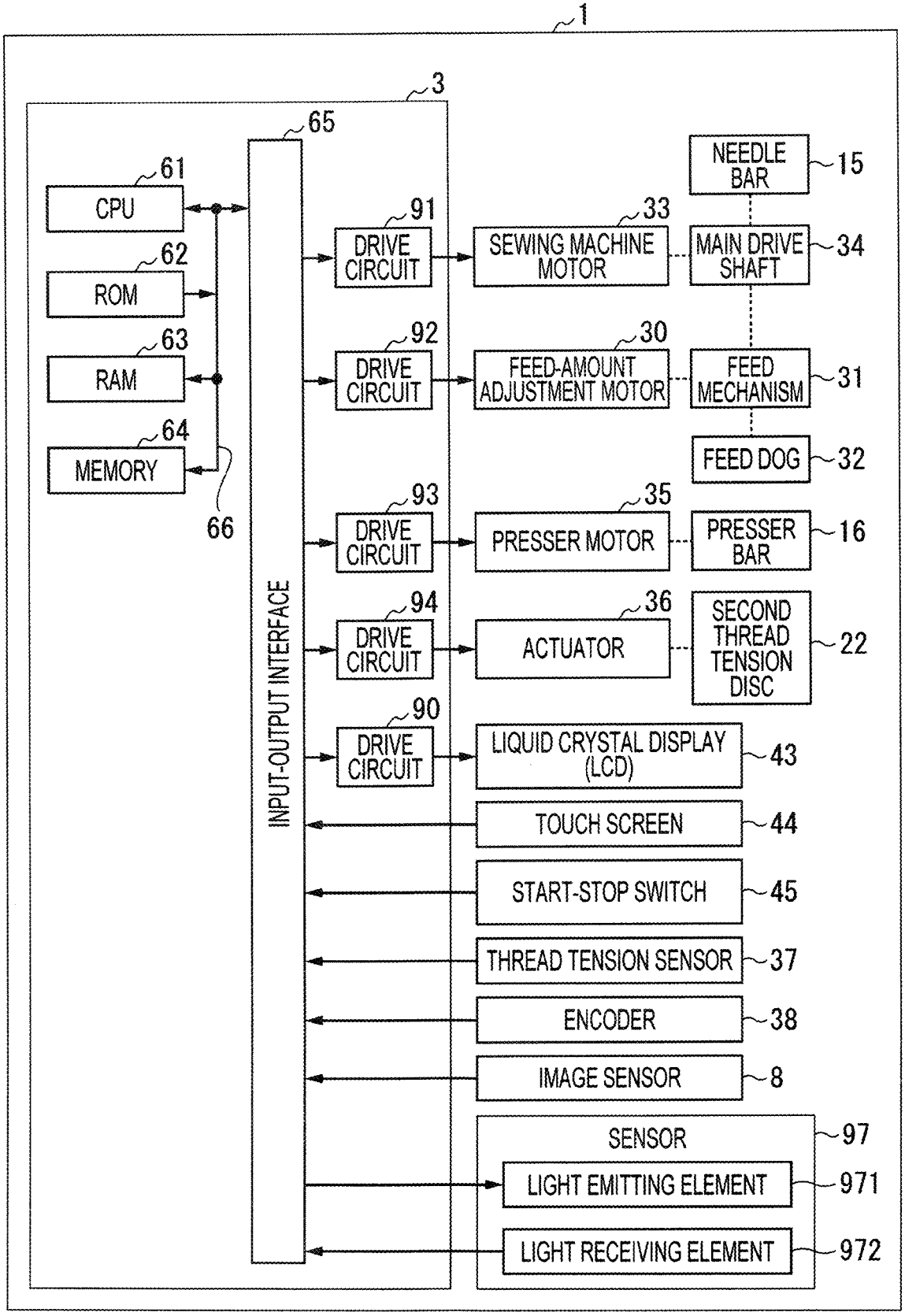
FIG. 7 is a block diagram illustrating an electrical configuration of the sewing machine 1.

A thread tensioner 20 is disposed leftward of the thread storage portion 50. The thread tensioner 20 is configured to adjust (regulate) the tension applied to an upper thread U. As shown in FIGS. 2A to 2C and FIG. 3, the thread tensioner 20 includes a support plate 49, a first thread tension disc 21, a second thread tension disc 22, a plate member 39, a spring 23, shafts 24 and 28, a slider 26, and a cam 27. The thread tensioner 20 also includes an actuator 36 and a thread tension sensor 37, which are shown in FIG. 7. The support plate 49 is a plate member that has an L-shape in a plan view. The support plate 49 is fixed to the main body of the sewing machine. A left end portion of the shaft 24 is fixed to the support plate 49.

The shaft 24 extends in the left-right direction. From left to right, the first thread tension disc 21, the second thread tension disc 22, the plate member 39, the spring 23, and the left end of the slider 26 are inserted in the shaft 24.

The first thread tension disc 21 and the second thread tension disc 22 are doughnut-shaped discs in a left side view. The first thread tension disc 21 is disposed leftward of the second thread tension disc 22. The first thread tension disc 21 is fixed to the shaft 24.

The second thread tension disc 22 is movable along the shaft 24. A first surface 221 of the second thread tension disc 22 faces the first thread tension disc 21. The first surface 221 is the left surface of the second thread tension disc 22. A second surface 222 of the second thread tension disc 22 faces the plate member 39. The second surface 222 is the surface opposite to the first surface 221 of the second thread tension disc 22. That is, the second surface 222 is the right surface of the second thread tension disc 22.

Figure 2A:
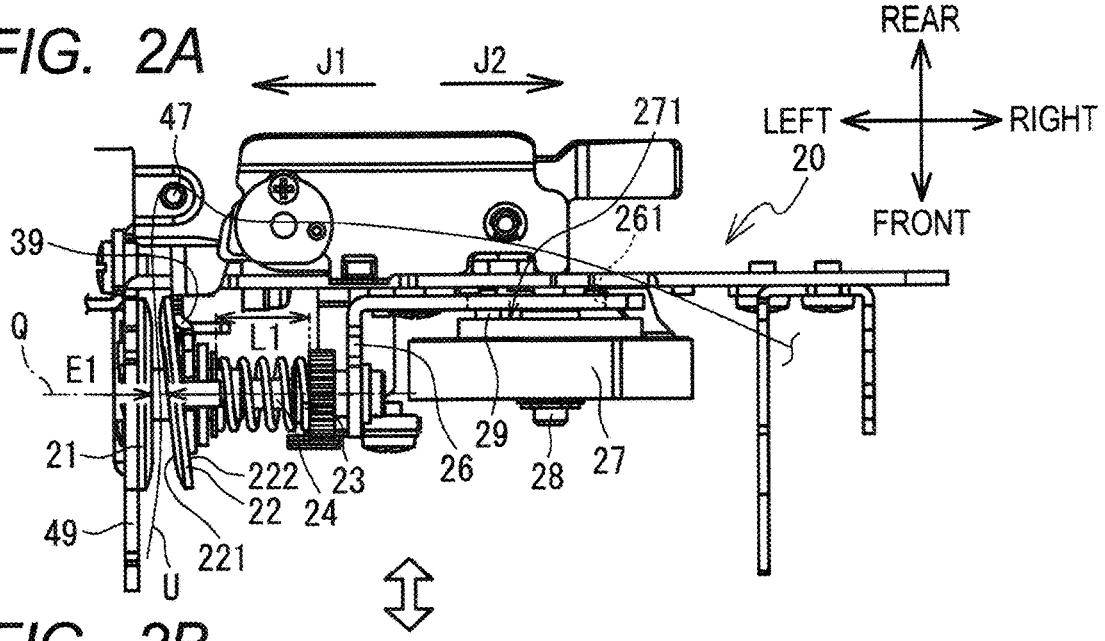
FIG. 2A is a plan view of a thread tensioner 20 in a case where a length of a spring 23 in a pressure direction J1 is a first length L1.
Figure 2B:
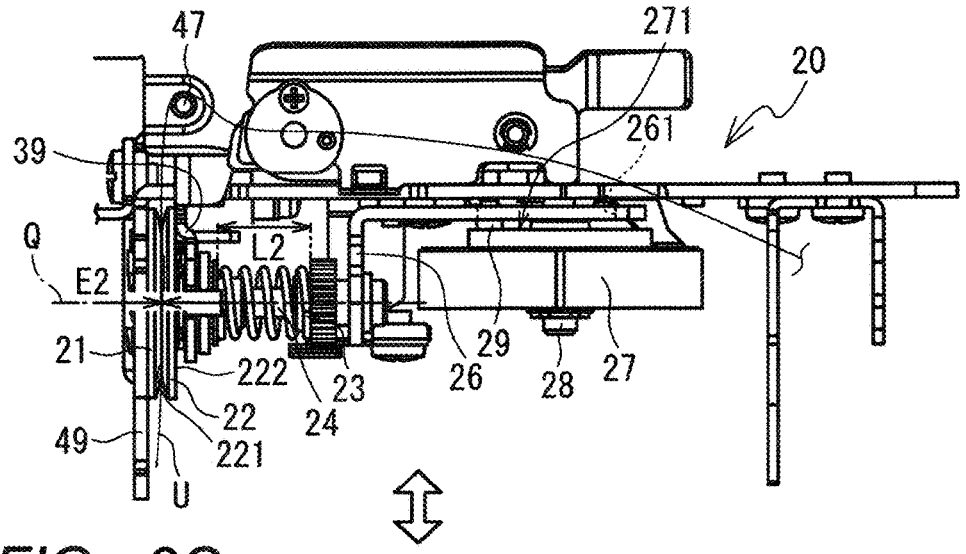
FIG. 2B is a plan view of the thread tensioner 20 in a case where the length of the spring 23 in the pressure direction J1 is a second length L2.
Figure 2C:
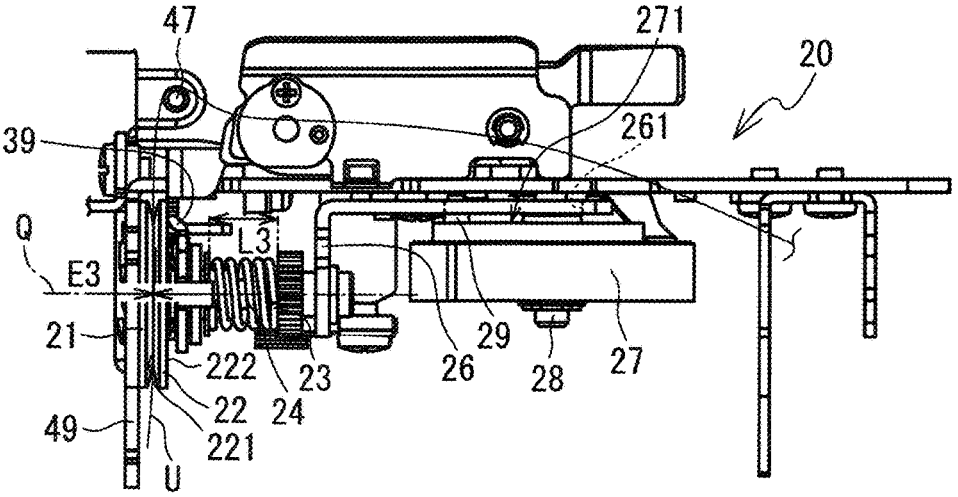
FIG. 2C is a plan view of the thread tensioner 20 in a case where the length of the spring 23 in the pressure direction J1 is a third length L3.

The plate member 39 is sandwiched between the second surface 222 of the second thread tension disc 22 and the left end of the spring 23. The spring 23 is a compression coil spring. The spring 23 presses (urges) the second thread tension disc 22 via the plate member 39. As the spring 23 expands and contracts, the plate member 39 is displaced horizontally. The thread tensioner 20 is configured to displace the second thread tension disc 22 between an open state and a contact state. As shown in FIG. 2A, in the open state, the second thread tension disc 22 separates from the first thread tension disc 21 rightward. As shown in FIGS. 2B and 2C, in the contact state, the second thread tension disc 22 is in contact with the first thread tension disc 21.

A shaft 55 extends below the shaft 24 in the left-right direction. A left end of the shaft 55 is fixed to the support plate 49. The shaft 55 is inserted into a spring 56. The spring 56 is a coil spring. The urging force of the spring 56 is less than the urging force of the spring 23. The lower end of the second thread tension disc 22 is constantly urged leftward by the spring 56. Thus, in the open state, the upper end of the second thread tension disc 22 separates from the first thread tension disc 21, whereas the lower end of the second thread tension disc 22 is pressed toward the first thread tension disc 21 by the spring 56.

The slider 26 is an L-shaped plate. The slider 26 is supported forward of the support plate 49 and rightward of the spring 23. The slider 26 is movable relative to the support plate 49 in the left-right direction. The slider 26 is urged, by the spring 23, in a counter-pressure direction J2, which is a direction opposite to a pressure direction J1. The slider 26 includes a pin 29 that protrudes forward from a front surface of the slider 26. A long hole 261 is formed in the slider 26 at a position rightward of the pin 29. The long hole 261 is formed through the slider 26 in the front-rear direction and is longer in the left-right direction than in the upper-lower direction.

Figure 3:
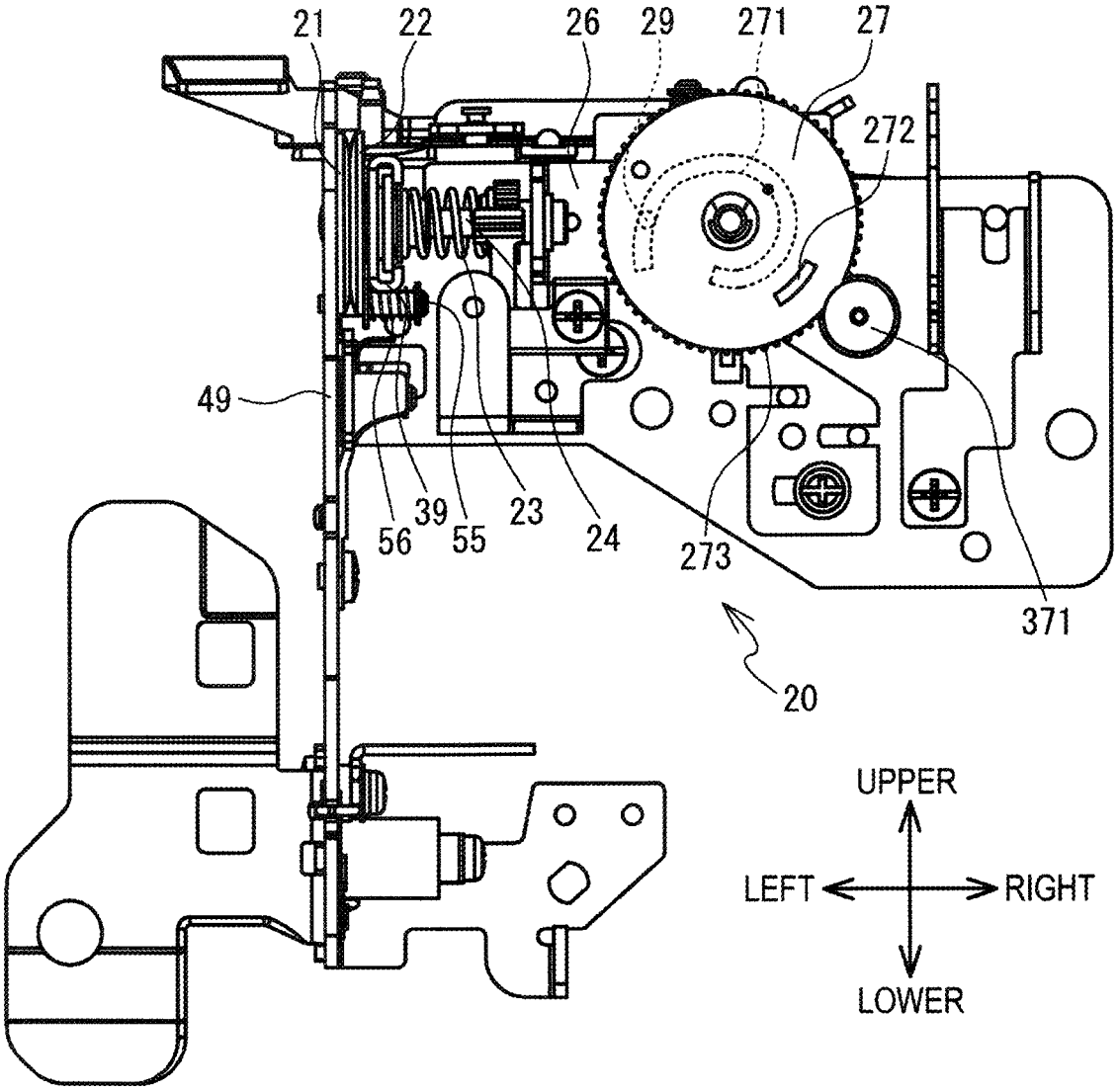
FIG. 3 is a front view of the thread tensioner 20.

The cam 27 is fixed to a front end portion of the shaft 28, which extends forward from a front surface of the support plate 49, in a manner that allows the cam 27 to rotate about the shaft 28. The shaft 28 is inserted through the long hole 261. As shown in FIG. 3, gear teeth 273 are formed around the circumference of the cam 27. The gear teeth 273 engage with a pinion gear 371 fixed to a rotary shaft of the actuator 36 shown in FIG. 7. The actuator 36 is a pulse motor and is attached to a rear surface of the support plate 49.

As shown in FIG. 3, an eccentric cam portion 271 is formed on a rear surface of the cam 27. The eccentric cam portion 271 is a forwardly recessed concave portion having a curved surface whose distance from the shaft 28 is not constant. The eccentric cam portion 271 makes sliding contact with the pin 29. A protrusion 272 is formed on a front surface of the cam 27. The protrusion 272 has an arc shape in a front view centered about the shaft 28. The protrusion 272 protrudes forward from the front surface of the cam 27.

When the rotary shaft of the actuator 36 rotates, the cam 27 that is engaged with the pinion gear 371 also rotates. When the cam 27 rotates, the eccentric cam portion 271 of the cam 27 moves the pin 29 in the left-right direction. Thus, when the cam 27 rotates, the slider 26 moves in the left-right direction while being guided by the long hole 261.

Each of a spring length, a disc spacing, and a thread tension pressure vary depending on the position of the slider 26 in the left-right direction. The spring length is the length of the spring 23 in the pressure direction J1. The disc spacing is defined as the spacing between the first thread tension disc 21 and the second thread tension disc 22 in the left-right direction, for example, the spacing between the first thread tension disc 21 and the second thread tension disc 22 on an axis Q of the shaft 24. The thread tension pressure is the pressure exerted by the spring 23 on the second thread tension disc 22 in the pressure direction J1.

The thread tension sensor 37 is disposed forward of the cam 27 and is configured to detect the phase of the cam 27 by detecting the position of the protrusion 272 on the front surface of the cam 27 in the thread tensioner 20. Since the phase of the cam 27 corresponds to the position of the slider 26, the sewing machine 1 determines each of the spring length, the disc spacing, and the thread tension pressure based on the phase of the cam 27.

Figure 4B:
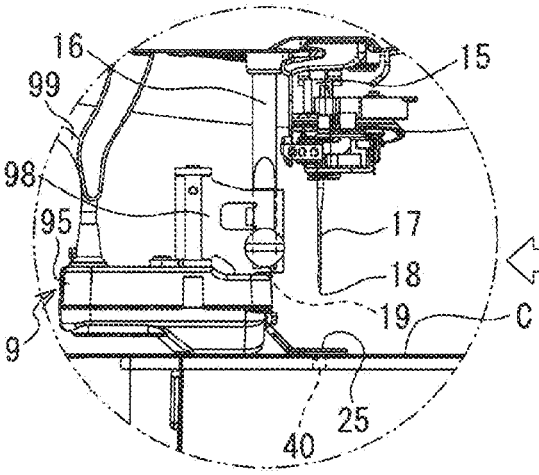
FIG. 4B is an enlarged view of the movement detector 9 in a state where a presser foot 25 contacts a sewing workpiece C.
Figure 4C:
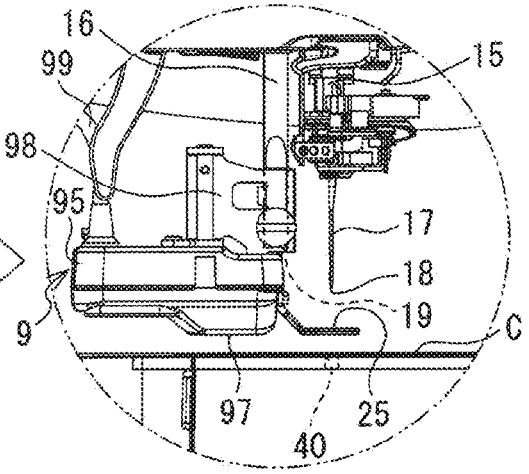
FIG. 4C is an enlarged view of the movement detector 9 in which the presser foot 25 is disposed a particular distance above the sewing workpiece C.

As shown in FIG. 1, the head 14 includes a needle bar mechanism, a presser foot mechanism, a thread take-up lever which are not shown, and an image sensor 8 shown in FIG. 7, inside the head 14. As shown in FIGS. 4A to 4C, the needle bar mechanism has a needle bar 15 extending in the upper-lower direction, and reciprocates the needle bar 15 in the upper-lower direction.

The lower end portion of the needle bar 15 protrudes downward from the lower end of the head 14. A sewing needle 17 is detachably attached to the lower end of the needle bar 15. The sewing needle 17 attached to the needle bar 15 reciprocates in the upper-lower direction. The upper thread U inserted through the sewing needle 17 is entangled with the lower thread by the hook, and forms a stitch on the sewing workpiece.

The presser foot mechanism includes the presser bar 16 extending in the upper-lower direction, and reciprocates the presser bar 16 in the upper-lower direction. The lower end portion of the presser bar 16 protrudes downward from the lower end of the head 14. The thread take-up lever is disposed between the thread tensioner 20 and the sewing needle 17 in the path of the upper thread U. The thread take-up lever pulls up the upper thread U that is entangled with the lower thread by the hook.

The image sensor 8 is attached to the main body of the sewing machine 1 so as to capture an image of a position including and near a needle point that is directly below the needle bar 15. The needle point is a point at which the sewing needle 17 is moved downward by the needle bar mechanism and pierces a sewing workpiece C. The image sensor 8 includes a CMOS sensor and a control circuit, and captures an image with the CMOS sensor.

A movement detector (movement sensor) 9 is used when the user performs sewing while manually moving the sewing workpiece C placed on the bed surface 10 without using the feed dog 32. The movement detector 9 detects movement of the sewing workpiece C placed on the needle plate 41, and outputs a detection result corresponding to the amount of movement (movement amount) of the sewing workpiece C. The movement detector 9 detects the movement amount of the sewing workpiece C disposed on the bed 11 below the presser bar 16, and outputs the movement amount to the sewing machine 1. The sewing machine 1 controls the driving of a sewing machine motor 33 shown in FIG. 7 based on the movement amount per unit time of the sewing workpiece C, that is, movement speed. Thereby, the sewing machine 1 adjusts (regulates) the length of the stitches formed on the sewing workpiece C.

As shown in FIGS. 4A to 4C, the movement detector 9 includes a housing 95, a sensor 97, a cable 99, and a mounting body (mounting bracket) 98. The housing 95 has a rectangular parallelepiped shape that is longer in the front-rear direction than in the left-right direction. The housing 95 is attachable to and detachable from the presser bar 16 of the sewing machine 1. The housing 95 accommodates the sensor 97.

Figure 6:
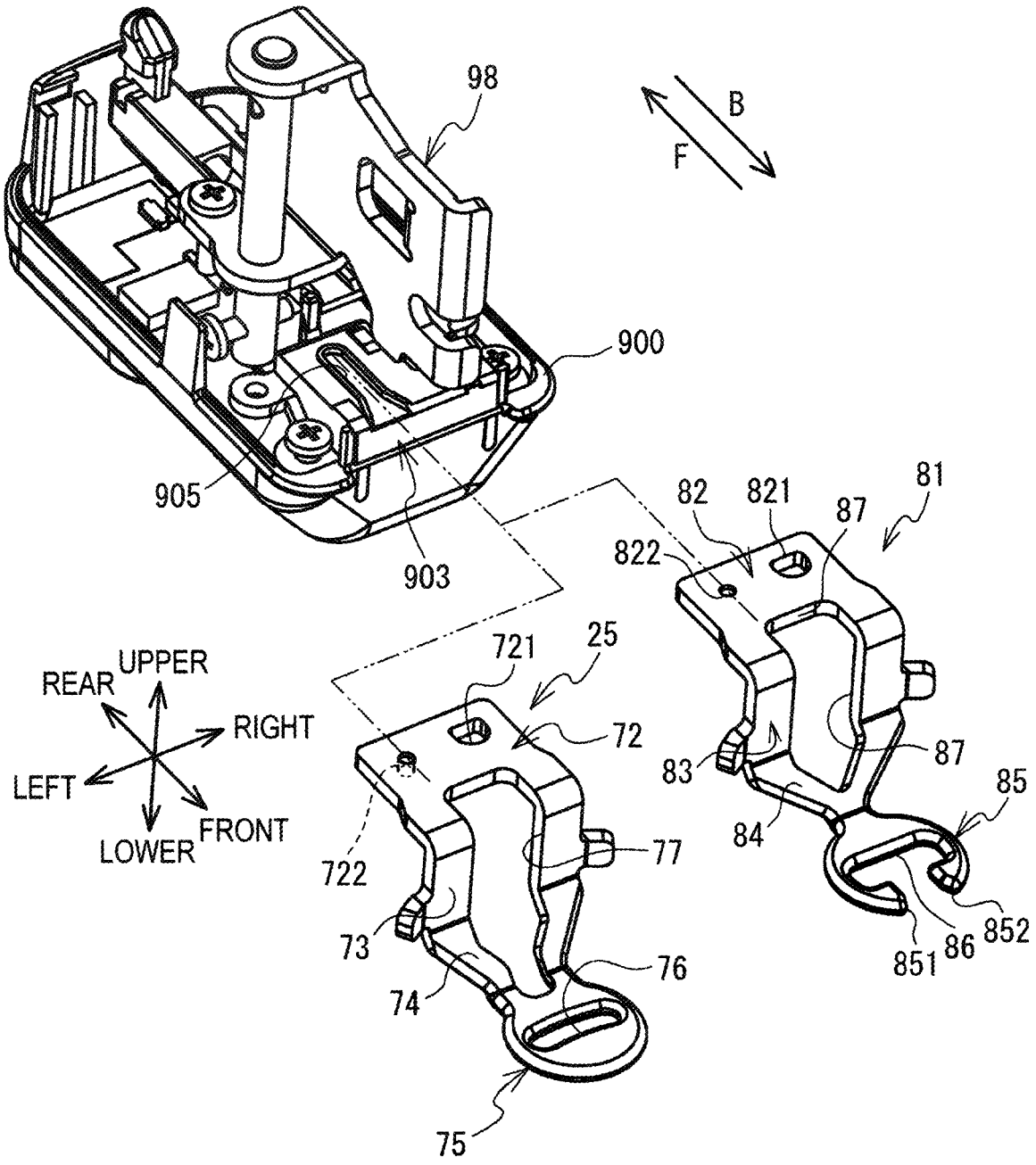
FIG. 6 is a perspective view of the presser foot 25, a presser foot 81, and the movement detector 9.

As shown in FIG. 6, a mounting portion 903 is formed in a lower portion 900 of the housing 95. A presser foot described later is detachably attached to the mounting portion 903. The mounting portion 903 is a recessed portion recessed rearward from the front surface of the housing 95. The mounting portion 903 includes a groove 905 extending in the front-rear direction.

The sensor 97 is located above an opening 100 formed in a lower surface 96 of the housing 95. As shown in FIG. 7, the sensor 97 includes a light emitting element 971 and a light receiving element 972. The light emitting element 971 and the light receiving element 972 are located above the opening 100. The light emitting element 971 emits light toward the sewing workpiece C to detect the movement amount of the sewing workpiece C. The light emitting element 971 is, for example, an infrared light emitting diode that emits infrared light.

In a state where the movement detector 9 is attached to the presser bar 16 of the sewing machine 1, the light emitted by the light emitting element 971 is emitted downward. The emitted light passes through the opening 100 and reaches the sewing workpiece C, and is reflected. The light reflected by the sewing workpiece C passes through the opening 100.

The light receiving element 972 is an element for detecting the light reflected by the sewing workpiece C located in a detection region, and detects the light reflected by the sewing workpiece C and converts the light into an electrical signal. The detection region is a circular region in plan view and is located below the opening 100. The light receiving element 972 is, for example, an infrared imaging element that detects infrared light.

The light emitting element 971 periodically emits light toward the sewing workpiece C, and the sensor 97 detects the movement amount of the sewing workpiece C per unit time. The movement detector 9 of the present embodiment detects each of a movement amount in the short direction D1 and a movement amount in the longitudinal direction D2. The movement detector 9 detects the movement amount in the short direction D1, where it is defined that a rearward movement amount is a positive (+) movement amount and a forward movement amount is a negative (−) movement amount. The movement detector 9 detects the movement amount in the longitudinal direction D2, where it is defined that a rightward movement amount is a positive (+) movement amount and a leftward movement amount is a negative (−) movement amount.

The cable 99 extends upward from rearward of the upper surface of the housing 95. The cable 99 is detachably connected to a connector (not shown) disposed at the back surface of the arm 13. The movement detector 9 outputs the movement amount of the sewing workpiece C per unit time to the sewing machine 1 via the cable 99.

The mounting body 98 extends upward from the upper surface of the housing 95. The mounting body 98 is detachably attached to the presser bar 16. With this configuration, the movement detector 9 is detachably attached to the lower end of the presser bar 16.

One of a plurality of types of presser feet is detachably attachable to the movement detector 9. The plurality of types of presser feet of the present embodiment include a presser foot 25 and a presser foot 81. The material of the presser foot 25 and the presser foot 81 is, for example, metal such as an aluminum alloy. The presser foot attached to the movement detector 9 is disposed above the upper surface of the sewing workpiece C by a particular distance at a normal position described later, and restricts the movement of the sewing workpiece C in the upper-lower direction within a range of the particular distance. Accordingly, the presser foot attached to the movement detector 9 prevents the sewing workpiece C placed on the bed surface 10 from lifting.

As shown in FIG. 6, the presser foot 25 includes an insertion plate 72, a connection plate 73, and a presser plate 75. The insertion plate 72 is perpendicular to the upper-lower direction and has a generally rectangular shape in plan view. The sizes of the insertion plate 72 in the left-right direction and the upper-lower direction are substantially the same as the sizes of the opening formed in the front surface of the movement detector 9 in the left-right direction and the upper-lower direction, respectively. The size of the insertion plate 72 in the front-rear direction is substantially the same as the size of the mounting portion 903 in the front-rear direction.

The insertion plate 72 is formed with an opening 721 and a protrusion 722. The opening 721 is formed through the insertion plate 72 in the upper-lower direction. The opening 721 is located between the right end of the insertion plate 72 and the center of the insertion plate 72 in the left-right direction. The opening 721 is located between the rear end of the insertion plate 72 and the center of the insertion plate 72 in the front-rear direction.

When the presser foot 25 is attached to the movement detector 9, the opening 721 is fitted to a fitting portion (not shown) of the movement detector 9. The protrusion 722 protrudes downward from the lower surface of the insertion plate 72 in a columnar shape. When the presser foot 25 is attached to the movement detector 9, the protrusion 722 engages with the groove 905 of the movement detector 9.

The connection plate 73 extends downward from the front end of the insertion plate 72. A hole 77 is formed in the connection plate 73 so as to pass through the connection plate 73 in the front-rear direction. This allows the user positioned forward of the sewing machine 1 to easily visually check the state of the sewing workpiece C disposed below the presser plate 75 through the hole 77. The state of the sewing workpiece C is, for example, the length of stitches formed on the sewing workpiece C, and the sewing direction.

The presser plate 75 extends perpendicularly to the upper-lower direction. The presser plate 75 has an insertion portion 76 through which the sewing needle 17 is inserted in the upper-lower direction. The insertion portion 76 of the presser plate 75 has a substantially O-shape in plan view, that is, an annular shape. The insertion portion 76 is a long hole that is long in the left-right direction in plan view. The presser plate 75 surrounding the insertion portion 76 has a tubular shape in plan view. The upper thread U is inserted through the insertion portion 76. When the upper thread U is inserted through the insertion portion 76, the movement of the upper thread U in a horizontal direction is restricted by the presser plate 75. In a state where the presser foot 25 is attached to the movement detector 9, the presser plate 75 contacts the sewing workpiece C from above and prevents the sewing workpiece C from lifting.

The presser foot 81 will be described mainly in terms of differences from the presser foot 25. The presser foot 81 includes an insertion plate 82 corresponding to the insertion plate 72, a connection plate 83 corresponding to the connection plate 73, and a presser plate 85 corresponding to the presser plate 75. The insertion plate 82 has an opening 821 and a protrusion 822. A hole 87 is formed in the connection plate 83 so as to pass through the connection plate 83 in the front-rear direction.

The presser plate 85 extends perpendicularly to the upper-lower direction. The presser plate 85 is formed with an insertion portion 86 through which the sewing needle 17 is inserted in the upper-lower direction. The insertion portion 86 is a recess recessed rearward from the front end of the presser plate 85. The insertion portion 86 of the presser plate 85 has a substantially C-shape that is open on the front side in plan view, that is, is not annular. A left front end 851 and a right front end 852 of the presser plate 85, which has a C-shape in plan view and surrounds the insertion portion 86, are spaced apart from each other in the left-right direction. The distance between the left front end 851 and the right front end 852 is large enough to allow at least the upper thread U to pass therethrough. When the upper thread U is inserted through the insertion portion 86, the upper thread U is partially restricted from moving in a horizontal direction by the presser plate 85, but is movable forward of the presser plate 85 through a gap between the left front end 851 and the right front end 852.

In the sewing machine 1 having the above-described configuration, an operation when the sewing workpiece is conveyed by the feed dog 32 will be briefly described. When the sewing machine 1 detects that the start-stop switch 45 has been pressed, the hook mechanism, the feed mechanism 31, the needle bar mechanism, and the presser foot mechanism are driven synchronously. With this operation, the sewing needle 17 attached to the needle bar 15 forms stitches in the sewing workpiece C placed on the bed surface 10.

Figure 5:
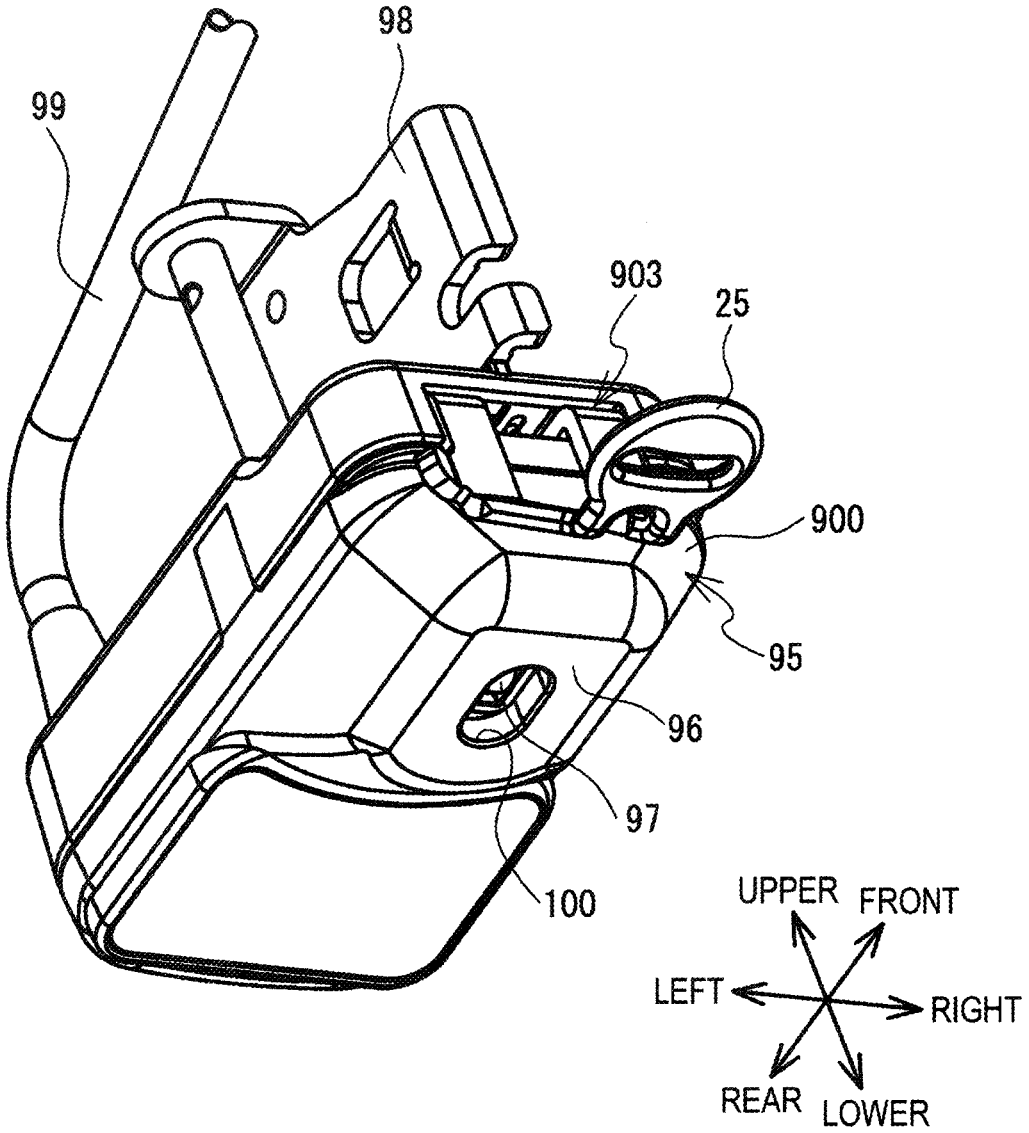
FIG. 5 is a perspective view of the movement detector 9.

The electrical configuration of the sewing machine 1 will be described with reference to FIG. 5. A controller 3 of the sewing machine 1 includes a CPU 61, a ROM 62, a RAM 63, a memory 64, and an input-output interface 65. The CPU 61 is connected to the ROM 62, the RAM 63, the memory 64, and the input-output interface 65 via a bus 66.

The CPU 61 performs main control of the sewing machine 1 and performs various calculations and processing related to sewing in accordance with various programs stored in the ROM 62. The ROM 62 includes a plurality of storage areas including a program storage area (not shown). The program storage area stores various programs for operating the sewing machine 1, including a program for performing a main process described later. The RAM 63 includes a storage area for storing the operation result of a calculation process performed by the CPU 61.

The memory 64 stores various parameters for the sewing machine 1 to perform various processes. The memory 64 stores a correspondence between a detection result of an encoder 38 described later and a vertical position of the needle bar 15, where it is defined that the angle of a main drive shaft 34 when the needle bar 15 is located at the top dead center is 0 degrees.

Drive circuits 90, 91, 92, 93 and 94 of the controller 3, the touch screen 44, the start-stop switch 45, a thread tension sensor 37, the encoder 38, the image sensor 8, and the light emitting element 971 and the light receiving element 972 of the sensor 97 of the movement detector 9 are connected to the input-output interface 65.

The sewing machine motor 33 is connected to the drive circuit 91. The drive circuit 91 drives the sewing machine motor 33 in accordance with a control signal from the CPU 61. When the sewing machine motor 33 is driven, the needle bar mechanism is driven via the main drive shaft 34 of the sewing machine 1, and the needle bar 15 reciprocates in the upper-lower direction.

The sewing machine motor 33 moves the needle bar 15 in the upper-lower direction in a range including an upper needle position and a lower needle position. The upper needle position is a position where a lower end 18 of the sewing needle 17 is above the needle plate 41. The lower needle position is a position where the lower end 18 of the sewing needle 17 is below the needle plate 41. The upper end of the movable range of the needle bar 15 is the top dead center, and the lower end of the movable range of the needle bar 15 is the bottom dead center.

A feed-amount adjustment motor 30 is connected to the drive circuit 92. The feed-amount adjustment motor 30 adjusts the feed amount of the sewing workpiece C in the front-rear direction by the feed mechanism 31, by rotating an output shaft.

The drive circuit 93 drives a presser motor 35 in accordance with a control signal from the CPU 61. Due to the driving of the presser motor 35, the presser bar 16 moves in the upper-lower direction independently of the driving of the main drive shaft 34 of the sewing machine 1. The presser motor 35 moves the presser bar 16 in the upper-lower direction in a range including a normal position and a lowered position. A lower end 19 of the presser bar 16 at the lowered position is located at a lower position than the lower end 19 of the presser bar 16 at the normal position. The upper end of the movable range of the presser bar 16 is a raised position above the normal position, and the lower end is a contact position where the presser foot 25 contacts the needle plate 41.

The drive circuit 94 drives the actuator 36 in accordance with a control signal from the CPU 61. The driving of the actuator 36 changes the length of the spring 23 in the pressure direction J1, and changes the thread tension pressure applied to the second thread tension disc 22 and the disc spacing. The drive circuit 90 drives the LCD 43 in accordance with a control signal from the CPU 61, thereby displaying an image on the LCD 43.

The thread tension sensor 37 outputs a detection result corresponding to the phase of the cam 27 to the input-output interface 65. The encoder 38 outputs a detection result corresponding to the rotation angle of the sewing machine motor 33 to the input-output interface 65.

Processing performed by the thread tensioner 20 to adjust (regulate) the thread tension pressure applied to the upper thread U will now be described. As shown in FIGS. 2A to 2C, the user places the upper thread U, that has been wound out from the thread spool T, on a guide pin 47. The guide pin 47 extends in the upper-lower direction at the rear of the first thread tension disc 21 and the second thread tension disc 22.

The user sandwiches the upper thread U placed on the guide pin 47 between the first thread tension disc 21 and the second thread tension disc 22 of the thread tensioner 20, then pulls the upper thread U down to insert the upper thread U through the sewing needle 17 via the take-up lever. In the open state shown in FIG. 2A, the first thread tension disc 21 and the second thread tension disc 22 are separated from each other in the left-right direction. Thus, in the open state, the user easily threads the upper thread U between the first thread tension disc 21 and the second thread tension disc 22.

When sewing is started, the actuator 36 rotates for a particular pulse in a particular direction in response to a command from the controller 3. The slider 26 moves leftward according to the rotation phase of the cam 27. When the slider 26 moves leftward, the spring 23 presses the second thread tension disc 22 in the pressure direction J1. The disc spacing between the first thread tension disc 21 and the second thread tension disc 22 is shorter as compared to before the slider 26 starts moving.

As shown in FIGS. 2B and 2C, when the slider 26 moves and the thread tensioner 20 is in the contact state, the disc spacing is approximately zero, leaving a space for the upper thread U to be sandwiched. In other words, when the thread tensioner 20 is in the contact state, the disc spacing is zero, provided that the upper thread U is not sandwiched between the first thread tension disc 21 and the second thread tension disc 22.

After the thread tensioner 20 enters the contact state, the slider 26 moves further leftward. As a result, the length of the spring 23 in the pressure direction J1 becomes shorter than before the slider 26 starts moving. Due to the leftward movement of the slider 26, the thread tension pressure applied by the spring 23 to the second thread tension disc 22 increases as compared to before the slider 26 starts moving. In other words, the tension applied to the upper thread U by the thread tensioner 20 increases as compared to before the slider 26 starts moving. The tension applied to the upper thread U by the thread tensioner 20 increases in the following order shown in the figures: FIG. 2A<FIG. 2B<FIG. 2C.

When the thread tensioner 20 shown in FIGS. 2B and 2C is switched from the contact state to the open state shown in FIG. 2A, the actuator 36 rotates for a particular pulse in a particular direction in response to a command from the controller 3. The slider 26 moves rightward according to the rotation phase of the cam 27. When the slider 26 moves rightward, the thread tension pressure applied by the spring 23 to the second thread tension disc 22 decreases as compared to before the slider 26 starts moving. The disc spacing and the spring length become longer as compared to before the slider 26 starts moving. In the open state shown in FIG. 2A, the tension applied to the upper thread U by the thread tensioner 20 becomes approximately zero.

Figure 11:
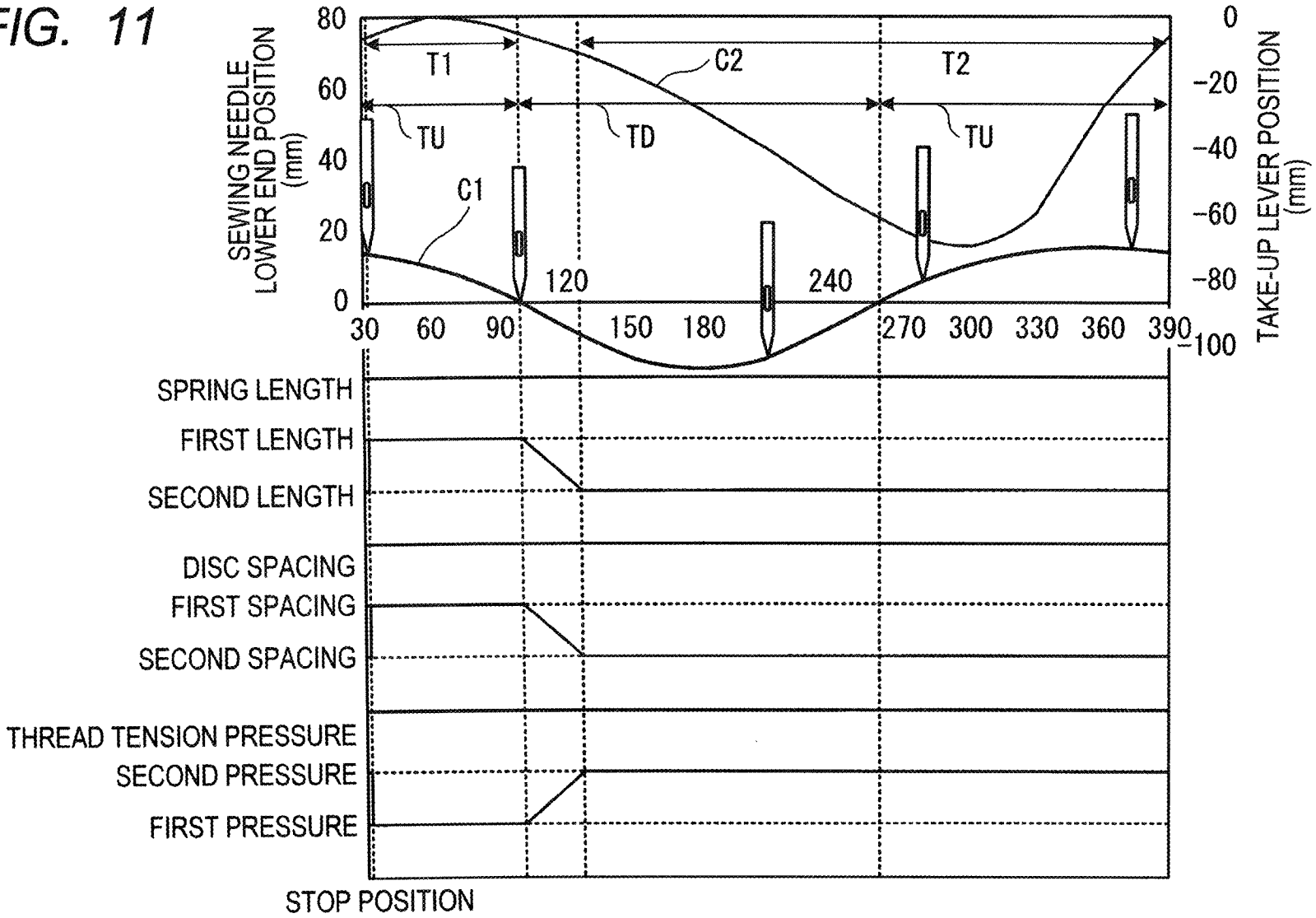
FIG. 11 is a graph showing a relationship among a needle lower end position, a thread take-up lever position, a disc spacing, a length of the spring 23 in the pressure direction J1, and a pressure applied to a second thread tension disc 22 with respect to a rotation angle of a main drive shaft 34.

Referring to FIG. 11, the relationship between the position of the lower end 18 of the sewing needle 17 in the upper-lower direction, the rotation angle of the main drive shaft 34, and the position of the take-up lever in the upper-lower direction will be described. As shown in FIG. 11, the position of the lower end 18 of the sewing needle 17 in the upper-lower direction varies periodically according to the rotation angle of the main drive shaft 34, where a sewing period is a unit period. The sewing period is a period in which sewing is performed for one stitch.

The vertical axis on the left side and a curve C1 in FIG. 11 represent the height of the lower end 18 of the sewing needle 17, where the height of the upper surface of the needle plate 41 is defined as 0 (mm). The vertical axis on the right side and a curve C2 in FIG. 11 represent the position of the take-up lever, where the position of the take-up lever at its highest point is defined as 0 (mm). The sewing period includes a take-up lever pull-up period in which the take-up lever pulls up the upper thread U and a hook catch period in which the hook catches the annular upper thread U by the tip of the hook. Although not shown in the drawings, the tension of the upper thread U varies during the sewing period and generally has peaks during the take-up lever pull-up period and the hook catch period. For example, the take-up lever pull-up period is a period in which the rotation angle of the main drive shaft 34 is from 279 degrees to 62 degrees in the next sewing period. The hook catch period is a period in which the rotation angle of the main drive shaft 34 is from 208 degrees to 330 degrees.

A main process of the sewing machine 1 will be described with reference to FIGS. 8 to 11. In the main process, the start-stop switch 45 is selected at the time of starting to sew or resuming sewing, with the movement detector 9 attached to the presser bar 16. In the main process, in response to detecting a sewing instruction, the needle bar 15 is reciprocated in the upper-lower direction based on a detection result of the movement detector 9, thereby performing sewing on the sewing workpiece C. When the controller 3 detects an instruction to perform the main process, the controller 3 reads out, to the RAM 63, a program for performing the main process stored in the program storage area of the ROM 62.

The controller 3 performs the following steps according to the instructions contained in the program read out to the RAM 63. The program includes instructions for causing the controller 3 to perform the following processes. The various parameters for performing the main process are stored in the memory 64. Various data obtained in the course of performing the main process are stored in the RAM 63 as appropriate. In the following description, "step" is abbreviated as "S."

At the start of the main process, the presser bar 16 is in a raised position and the needle bar 15 is in a stop position or a lower needle position. The stop position may be any position where the lower end 18 of the sewing needle 17 is above the needle plate 41. According to this embodiment, the stop position is a position where the rotation angle of the main drive shaft 34 is 32 degrees and the needle bar 15 is located slightly below the top dead center. The lower needle position is a position where the lower end 18 of the sewing needle 17 is lower than the needle plate 41. According to this embodiment, the lower needle position is a position where the rotation angle of the main drive shaft 34 is 125 degrees and the lower end 18 of the sewing needle 17 is a middle point from the position where the lower end 18 is at the same height as the needle plate 41 to the bottom dead center.

When the main process is being performed, the feed dog 32 is disposed such that the upper end of the feed dog 32 is not higher than the needle plate 41. When the main process is being performed, the presser bar 16 does not move in the upper-lower direction along with the upper-lower movement of the needle bar 15, unlike during sewing using the feed dog 32.

Figure 8:
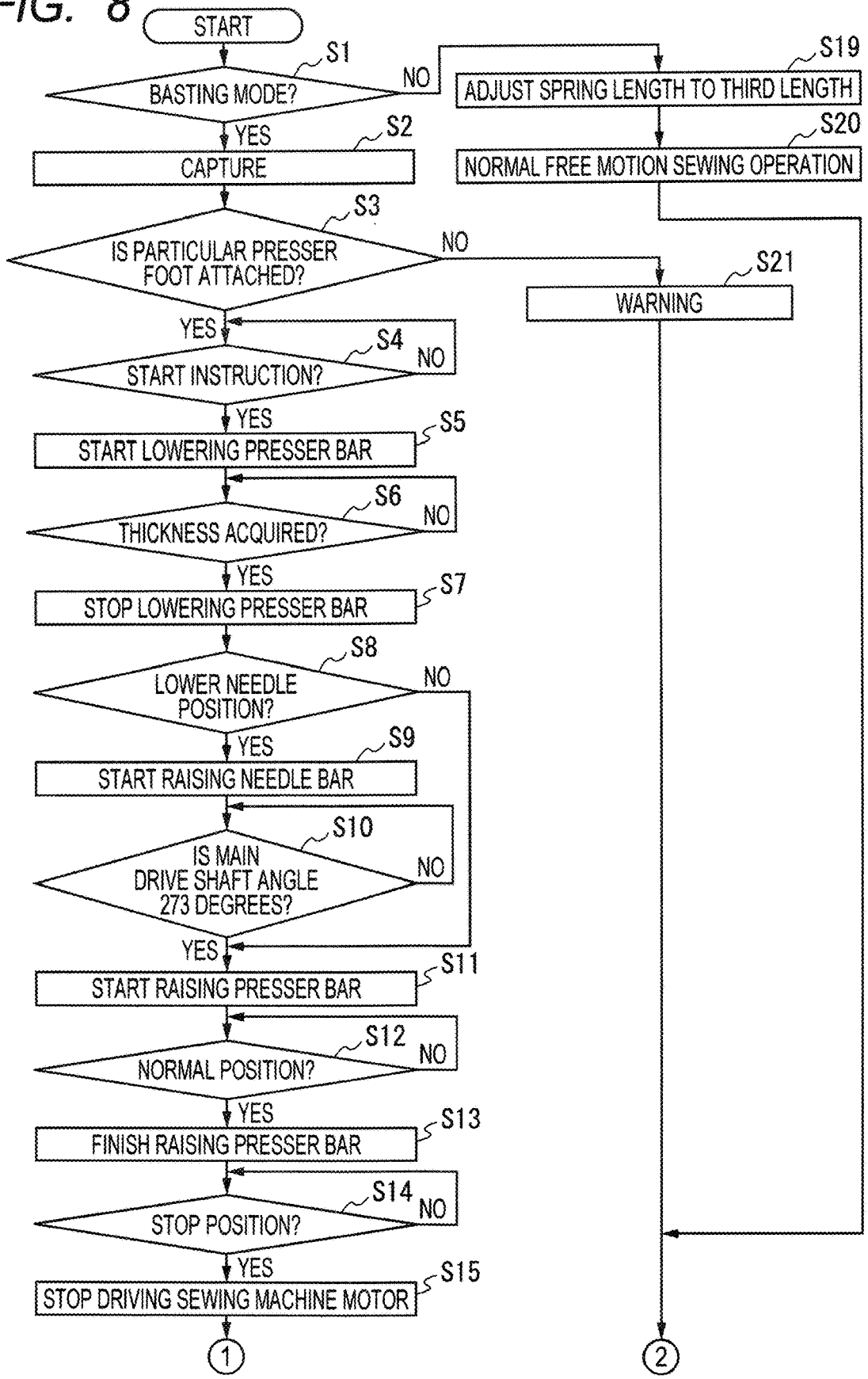
FIG. 8 is a flowchart of a main process performed when the movement detector 9 is attached.

As shown in FIG. 8, in the main process, the controller 3 determines whether an instruction to select a basting mode has been detected (S1). The sewing machine 1 according to this embodiment selects a sewing mode for sewing from among multiple modes based on the signal output by the movement detector 9. The sewing mode defines the conditions under which the needle bar 15 is driven based on the signal output by the movement detector 9. The multiple modes according to this embodiment include an intermittent mode, the basting mode, and a continuous mode.

In the intermittent mode and the basting mode, when the amount of movement of the sewing workpiece C detected by the movement detector 9 is zero, the controller 3 stops the reciprocating movement of the needle bar 15 in the upper-lower direction. When the amount of movement is larger than zero, the controller 3 causes the needle bar 15 to reciprocate in the upper-lower direction at a speed corresponding to the amount of movement. The method of reciprocating the needle bar 15 at a speed corresponding to the amount of movement may be starting movement of the needle bar 15 when the detected movement amount reaches a threshold which is set to a particular movement amount, for example. The stitch length in the basting mode is longer than the stitch length in the intermittent mode. In other words, the threshold of the movement amount in the basting mode is larger than the threshold of the movement amount in the intermittent mode.

In the continuous mode, when the movement amount of the sewing workpiece C detected by the movement detector 9 is zero, the controller 3 causes the needle bar 15 to reciprocate in the upper-lower direction at a particular speed. When the movement amount is larger than zero, the controller 3 causes the needle bar 15 to reciprocate in the upper-lower direction at a speed corresponding to the movement amount.

The stitch length in the basting mode is longer than the stitch length in the continuous mode. In other words, the threshold of the movement amount in the basting mode is larger than the threshold of the movement amount in the continuous mode. The basting mode is a mode for basting, and the intermittent mode and the continuous mode are for modes for permanent sewing. In this specification, normal sewing other than basting will be referred to as "permanent sewing".

Stitches of basting are formed, for example, to temporarily fasten two workpieces together and are removed after permanent stitches are formed. Thus, the stitch length of the basting is generally set longer than the stitch length of one stitch in permanent sewing. The stitch length of one stitch in permanent sewing corresponds to an amount by which the sewing workpiece is fed by the feed dog 32, which is, for example, between 0.2 mm and 5.0 mm.

In a case where an instruction to select the basting mode is not detected and the basting mode is not performed (S1: NO), while performing a free motion sewing operation, the controller 3 controls the actuator 36 to perform a length adjustment process of adjusting the length of the spring 23 in the pressure direction J1 to a third length L3, which is shorter than a second length L2 (S19).

As shown in FIG. 2C, the controller 3 performs normal free motion sewing, that is, the intermittent mode or the continuous mode in a state where the spring length is adjusted to the third length L3 (S20). The normal free motion sewing is a type of permanent sewing. When the spring length is the third length L3, the disc spacing is third spacing E3, which is approximately the same as second spacing E2. When the spring length is the third length L3, the thread tension pressure is a third pressure, which is higher than a second pressure. With this configuration, in a case where no instruction to select the basting mode is detected, that is, basting is not to be performed (S1: NO), the controller 3 does not perform a thread tension control operation described later and instead performs free motion sewing in a state where the spring length, the disc spacing, and the thread tension pressure are kept constant. The instruction to select the basting mode is processed as an instruction to perform the thread tension control operation.

In a case where the instruction to select the basting mode is detected (S1: YES), the controller 3 controls the image sensor 8 to capture an image of the presser foot attached to the movement detector 9 (S2). The controller 3 analyzes the image data captured in S2 to determine whether the presser foot attached to the movement detector 9 is a particular presser foot (S3). The method of analyzing the image data may be set as appropriate. For example, in the method, training data may be generated by causing a neural network to learn images of a particular presser foot. Then, based on the training data, the controller 3 detects the shape of the presser foot in plan view attached to the movement detector 9 from the captured image data. The particular presser foot may be set as appropriate. In this embodiment, the particular presser foot is a presser foot including the O-shaped insertion portion in plan view.

In a case where the presser foot 81 is attached to the movement detector 9 and it is determined that the insertion portion of the presser foot does not have an O-shape in plan view (S3: NO), that is, the presser foot includes a C-shaped insertion portion in plan view, the controller 3 does not perform basting and outputs a warning (S21). For example, the controller 3 displays a warning message on the LCD 43 that states, "Please attach a presser foot having an O-shaped insertion portion."

With this configuration, the controller 3 according to this embodiment does not perform basting in a case where the presser foot includes a C-shaped insertion portion in plan view. In a case where a presser foot 25 including the O-shaped insertion portion in plan view is attached to the movement detector 9, the upper thread U is held by the presser foot 25. In a case where the presser foot 81 including the C-shaped insertion portion in plan view is attached to the movement detector 9, there is a possibility that the upper thread U slips out of the gap of the presser foot 81 and the upper thread U will not be held by the presser foot 81. This is because, in a case where the presser foot 81 including the C-shaped insertion portion in plan view is attached to the movement detector 9, the tension of the upper thread U extending from the stitch that is already formed in the sewing workpiece C may be directly applied to the sewing workpiece C from the sewing needle 17, and thus resistance of moving the sewing workpiece C forward is increased, as compared to the case where the presser foot 25 including the O-shaped insertion portion in plan view is attached to the movement detector 9. The controller 3 ends the main process.

In a case where the presser foot attached to the movement detector 9 is the particular presser foot (S3: YES), that is, the presser foot has the O-shaped insertion portion in plan view, the controller 3 determines whether a start instruction to start free motion sewing is detected (S4). The user operates the start-stop switch 45 to input the start instruction. In a case where the start instruction is not detected (S4: NO), the controller 3 returns the process to S4.

In a case where the start instruction is detected (S4: YES), the controller 3 drives the presser motor 35 to start lowering the presser bar 16 (S5), as shown in FIG. 2B. The controller 3 determines whether the thickness of the sewing workpiece C is acquired based on the position at which the presser foot 25 contacts the sewing workpiece C (S6). In a case where the thickness is not acquired (S6: NO), the controller 3 returns the processing to S6. In a case where the thickness is acquired (S6: YES), the controller 3 stops lowering the presser bar 16 at the position at which the presser foot 25 of the movement detector 9 contacts the sewing workpiece C (S7).

The controller 3 determines whether the needle bar 15 is located at the lower needle position based on the detection result of the encoder 38 (S8). In a case where the needle bar 15 is not located at the lower needle position (S8: NO), the controller 3 performs the processing in S11 described below. In a case where the needle bar 15 is located at the lower needle position (S8: YES), the controller 3 controls the sewing machine motor 33 to start raising the needle bar 15 at a raising speed (S9). The raising speed is any preset speed and may be, for example, 70 rpm.

The controller 3 determines whether the rotation angle of the main drive shaft 34 has reached a particular angle based on the detection result of the encoder 38 (S10). The particular angle is an angle of an upper needle position at which the lower end 18 of the sewing needle 17 is above the needle plate 41. The upper needle position according to this embodiment is a position at which the lower end 18 of the sewing needle 17 is above the needle plate 41 and the lower end 18 of the sewing needle 17 is above the upper surface of the sewing workpiece C. The upper needle position may be set based on the thickness of the sewing workpiece C obtained in S2, or may be a value set based on the maximum thickness of the sewing workpiece C that is normally sewn. The particular angle according to this embodiment is 273 degrees, for example.

In a case where the rotation angle of the main drive shaft 34 has not reached the particular angle (S10: NO), the controller 3 returns the processing to S10. In a case where the rotation angle of the main drive shaft 34 has reached the particular angle (S10: YES), the controller 3 controls the presser motor 35 to start raising the presser bar 16 (S11).

The controller 3 determines whether the presser bar 16 has reached a normal position (S12). The controller 3 may make the determination in S12 based on a drive amount of the presser motor 35 determined in S11. The controller 3 may make the determination in S12 based on the detection result of the encoder 38 that detects the rotation angle of the presser motor 35. As shown in FIG. 4C, after acquiring the thickness of the sewing workpiece C, the controller 3 drives the presser motor 35 and disposes the presser foot 25 at the normal position which is a particular distance above the position at which the presser foot 25 contacts the sewing workpiece C. The particular distance is set to a value between 1 mm and 4 mm, for example.

In a case where the presser bar 16 has not reached the normal position (S12: NO), the controller 3 returns the processing to S12. In a case where the presser bar 16 has reached the normal position (S12: YES), the controller 3 controls the presser motor 35 to finish raising the presser bar 16 (S13). The controller 3 determines whether the rotation angle of the main drive shaft 34 has reached a stop angle corresponding to the stop position based on the detection result of the encoder 38 (S14). The stop position is a position at which the lower end 18 of the sewing needle 17 is above the needle plate 41.

In a case where the rotation angle of the main drive shaft 34 has not reached the stop angle (S14: NO), the controller 3 returns the processing to S14. In a case where the rotation angle of the main drive shaft 34 has reached the stop angle (S14: YES), the controller 3 stops driving the sewing machine motor 33 (S15).

Figure 9:
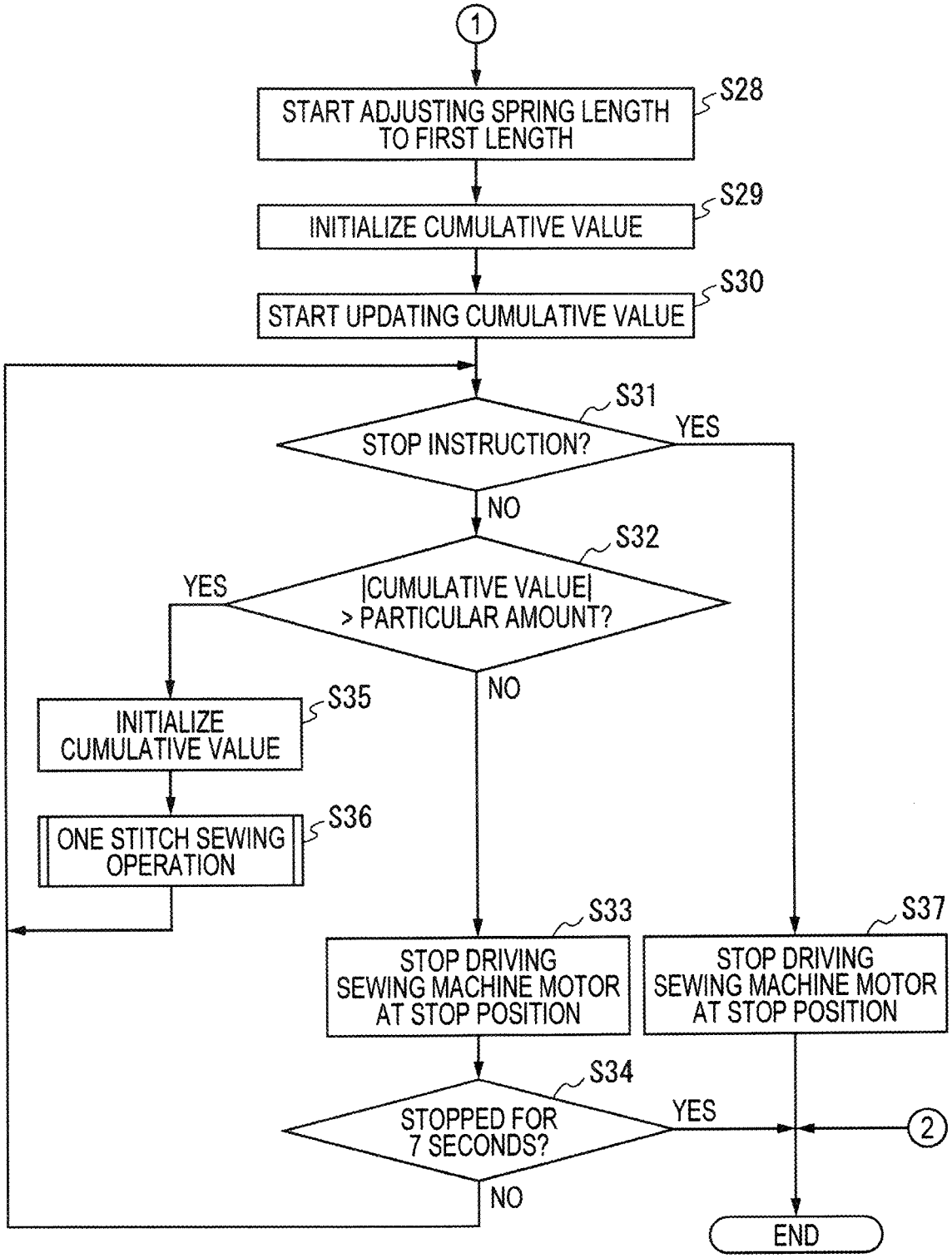
FIG. 9 is a flowchart of the remaining part of the main process.

As shown in FIG. 9, the controller 3 controls the actuator 36 to start adjusting the length of the spring 23 in the pressure direction J1 in a first period T1 to a first length L1 shown in FIG. 2A (S28). From the viewpoint of improving maneuverability for moving the sewing workpiece C during the free motion sewing operation, first spacing E1 may be set to a value sufficiently larger than the thickness of the upper thread U, for example, two times larger than the thickness of the upper thread U. In other words, the first pressure may be set to a value that is approximately zero. The controller 3 initializes a cumulative value of the movement amount of the sewing workpiece C according to the detection result of the movement detector 9 (S29). The controller 3 starts updating the cumulative value based on the detection result of the movement detector 9 (S30). By a process that is performed separately, the movement amount of the sewing workpiece C is added to the cumulative value, based on the detection result of the movement detector 9.

The controller 3 determines whether a stop instruction is detected (S31). To end the free motion sewing, the user operates the start-stop switch 45 to input the stop instruction.

In a case where the stop instruction is not detected (S31: NO), the controller 3 determines whether the absolute value of the cumulative value is larger than a particular amount (S32). In this embodiment, the controller 3 determines whether the movement amount detected by the movement detector 9 in the free motion sewing operation has reached the particular amount during a needle up period TU and does not perform this determination during a needle down period TD. The particular amount may be any amount previously set in consideration of the stitch length for basting, and may be, for example, set to between 10 mm and 40 mm automatically or by the user. In this embodiment, the controller 3 sets, as the particular amount, a value selected automatically from among 10 mm, 20 mm, and 30 mm or by the user.

In a case where the absolute value of the cumulative value is larger than the particular amount (S32: YES), the controller 3 initializes the cumulative value, setting the cumulative value to zero (S35), and then performs a one stitch sewing operation (S36). The controller 3 controls the sewing machine motor 33 to start the one stitch sewing operation in a state where the length of the spring 23 in the pressure direction J1 is the first length L1. In the one stitch sewing operation, the controller 3 performs the free motion sewing operation and the thread tension adjustment process. In the free motion sewing operation, the controller 3 drives the sewing machine motor 33 to move the needle bar 15 up and down in a state where the upper end of the feed dog 32 is located below the needle plate 41. In the free motion sewing operation, when the movement amount detected by the movement detector 9 reaches the particular amount (S32: YES), the controller 3 controls the sewing machine motor 33 to sew one stitch (S36).

In the thread tension adjustment process, while performing the free motion sewing operation, the controller 3 controls the actuator 36 to adjust the length of the spring 23 in the pressure direction J1 during the first period T1 to the first length L1. While performing the free motion sewing operation, the controller 3 controls the actuator 36 to adjust the length of the spring 23 in the pressure direction J1 during a second period T2 to the second length L2, which is shorter than the first length L1. In other words, the thread tension adjustment process is a process in which, while performing the free motion sewing operation, the controller 3 controls the actuator 36 to adjust the thread tension pressure during the first period T1 to the first pressure and adjust the thread tension pressure during the second period T2 to the second pressure, which is higher than the first pressure. In the thread tension adjustment process, while performing the free motion sewing operation, the controller 3 controls the actuator 36 to adjust the disc spacing during the first period T1 to the first spacing E1. In the thread tension adjustment process, the controller 3 adjusts the disc spacing during the second period T2 to the second spacing E2, which is shorter than the first spacing E1.

The first period T1 is at least part of the needle up period TU in which the lower end 18 of the sewing needle 17 is above the needle plate 41, in the sewing cycle for one stitch. In this embodiment, the first period T1 includes a period in which the needle bar 15 is disposed at the stop position. In this embodiment, the first period T1 is the period from the time when the needle bar 15 is disposed at the stop position to the time when the lower end 18 of the sewing needle 17 is located at the same position as the upper surface of the needle plate 41 in the upper-lower direction.

In the sewing cycle for one stitch, the second period T2 is a period that does not overlap with the first period T1. The second period T2 includes at least part of the needle down period TD in which the lower end 18 of the sewing needle 17 is below the needle plate 41. According to this embodiment, the second period T2 is the period from the time when the spring length is adjusted to the second length L2 to the time when the needle bar 15 is disposed at the stop position. The time when the spring length is adjusted to the second length L2 is in a period from the time when the lower end 18 of the sewing needle 17 is disposed at the same position as the upper surface of the needle plate 41 in the upper-lower direction to the time when the needle bar 15 is disposed at the bottom dead center. The second period T2 includes the hook catch period. The second period T2 includes a part of the take-up lever pull-up period.

In this embodiment, the controller 3 performs the thread tension adjustment process in a case where an instruction is detected in S1, that is, in a case where basting is to be performed (S1: YES). In this embodiment, the controller 3 performs basting in a case where the presser foot attached to the movement detector 9 includes an O-shaped insertion portion in plan view (S3: YES).

Figure 10:
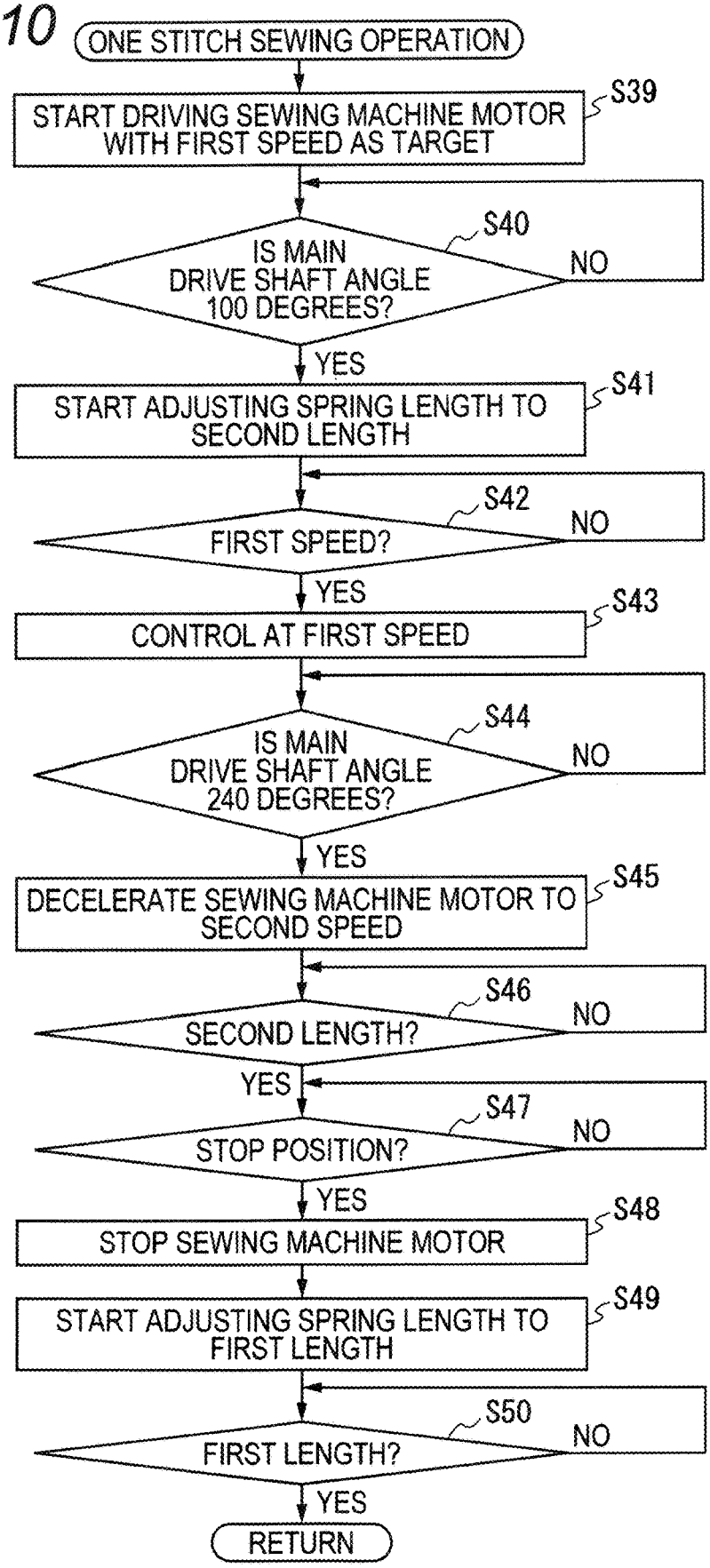
FIG. 10 is a flowchart of a one stitch sewing operation performed in the main process.

As shown in FIG. 10, in the one stitch sewing operation, the controller 3 starts driving the sewing machine motor 33 with a first speed as a target speed (S39). The first speed is set in consideration of the time required for the actuator 36 to change the spring length from the first length L1 to the second length L2 while performing the processes from S41 to S44. Specifically, in S41, in the free motion sewing operation, the controller 3 drives the sewing machine motor 33 at the first speed when the movement amount detected by the movement detector 9 has reached the particular amount (S32: YES), where the first speed is a speed at which the spring length during the second period T2 is adjustable to the second length L2. The first speed is, for example, 300 rpm.

The controller 3 determines whether the rotation angle of the main drive shaft 34 has reached 100 degrees based on the detection result of the encoder 38 (S40). As shown in FIG. 11, when the rotation angle of the main drive shaft 34 is 100 degrees, the lower end 18 of the sewing needle 17 is located at the same position as the upper surface of the needle plate 41 in the upper-lower direction. In a case where the rotation angle of the main drive shaft 34 has not reached 100 degrees (S40: NO), the controller 3 returns the processing to S40. In a case where the rotation angle of the main drive shaft 34 has reached 100 degrees (S40: YES), the controller 3 controls the actuator 36 and starts adjusting the spring length during the second period T2 to the second length L2, which is shorter than the first length L1 (S41).

The controller 3 determines whether the rotation speed of the sewing machine motor 33 has reached a first speed based on the detection result of the encoder 38 (S42). In a case where the rotation speed of the sewing machine motor 33 has not reached the first speed (S42: NO), the controller 3 returns the processing to S42.

In a case where the rotation speed of the sewing machine motor 33 has reached the first speed (S42: YES), the controller 3 controls the sewing machine motor 33 at the first speed (S43). Then, the controller 3 determines whether the rotation angle of the main drive shaft 34 has reached 240 degrees based on the detection result of the encoder 38 (S44). As shown in FIG. 11, in a case where the rotation angle of the main drive shaft 34 is 240 degrees, the lower end 18 of the sewing needle 17 is located below the needle plate 41. In a case where the rotation angle of the main drive shaft 34 has not reached 240 degrees (S44: NO), the controller 3 returns the processing to S44. In a case where the rotation angle of the main drive shaft 34 has reached 240 degrees (S44: YES), the controller 3 decelerates the sewing machine motor 33 to a second speed, which is slower than the first speed (S45). The second speed may be any speed slower than the first speed and may be 70 rpm, for example.

The controller 3 determines whether the spring length has reached the second length L2 based on the detection result of the thread tension sensor 37 (S46). As shown in FIG. 11, in the sewing machine 1 according to this embodiment, the spring length already reaches the second length L2 at a time when the rotation angle of the main drive shaft 34 reaches 240 degrees. That is, the disc spacing is adjusted to the second spacing E2 and the thread tension pressure is adjusted to the second pressure.

In a case where the spring length has not reached the second length L2 (S46: NO), the controller 3 returns the processing to S46. In a case where the spring length has reached the second length L2 (S46: YES), the controller 3 stops driving the actuator 36 to maintain the spring length at the second length L2. Based on the detection result of the encoder 38, the controller 3 determines whether the rotation angle of the main drive shaft 34 has reached a stop angle corresponding to the stop position (S47).

In a case where the rotation angle of the main drive shaft 34 has not reached the stop angle (S47: NO), the controller 3 returns the processing to S47. In a case where the rotation angle of the main drive shaft 34 has reached the stop angle (S47: YES), the controller 3 performs a one stitch stop operation (S48). In the one stitch stop operation, the controller 3 controls the sewing machine motor 33 to stop the needle bar 15 for each stitch (that is, each time one stitch is formed) at the stop position at which the lower end 18 of the sewing needle 17 is above the needle plate 41. In the basting mode, the length of one stitch is longer than the length of one stitch in permanent sewing, and thus the controller 3 performs the processing of S48 to secure enough time to move the sewing workpiece C.

The controller 3 controls the actuator 36 to start adjusting the spring length during the first period T1 to the first length L1 (S49). The controller 3 determines whether the spring length has reached the first length L1 based on the detection result of the thread tension sensor 37 (S50). In a case where the spring length has not reached the first length L1 (S50: NO), the controller 3 returns the processing to S50.

When the spring length has reached the first length L1 (S50: YES), the controller 3 stops driving the actuator 36 to maintain the spring length at the first length L1. The controller 3 ends the one stitch sewing operation and returns the processing to the main process. In other words, the one stitch sewing operation is performed again, the controller 3 controls the sewing machine motor 33 to start the one stitch sewing operation in a state where the length of the spring 23 in the pressure direction J1 is the first length L1.

As shown in FIG. 9, subsequent to the processing of S36, the controller 3 returns the processing to S31. In a case where the absolute value of the cumulative value is not larger than the particular amount (S32: NO), the controller 3 stops driving the sewing machine motor 33 at the stop position (S33).

The controller 3 determines whether the sewing workpiece C is stopped continuously for a particular period based on the detection result of the movement detector 9 (S34). The particular period may be a period set in advance or a period set by the user. The particular period may be, for example, 7 seconds. In a case where the sewing workpiece C is not stopped continuously for the particular period (S34: NO), the controller 3 returns the processing to S31. In a case where the sewing workpiece C is stopped continuously for the particular period (S34: YES), the controller 3 ends the main process.

In a case where the stop instruction is detected (S31: YES), the controller 3 stops driving the sewing machine motor 33 when the rotation angle of the main drive shaft 34 reaches the stop angle (S37). The controller 3 ends the main process.

Figure 12A:
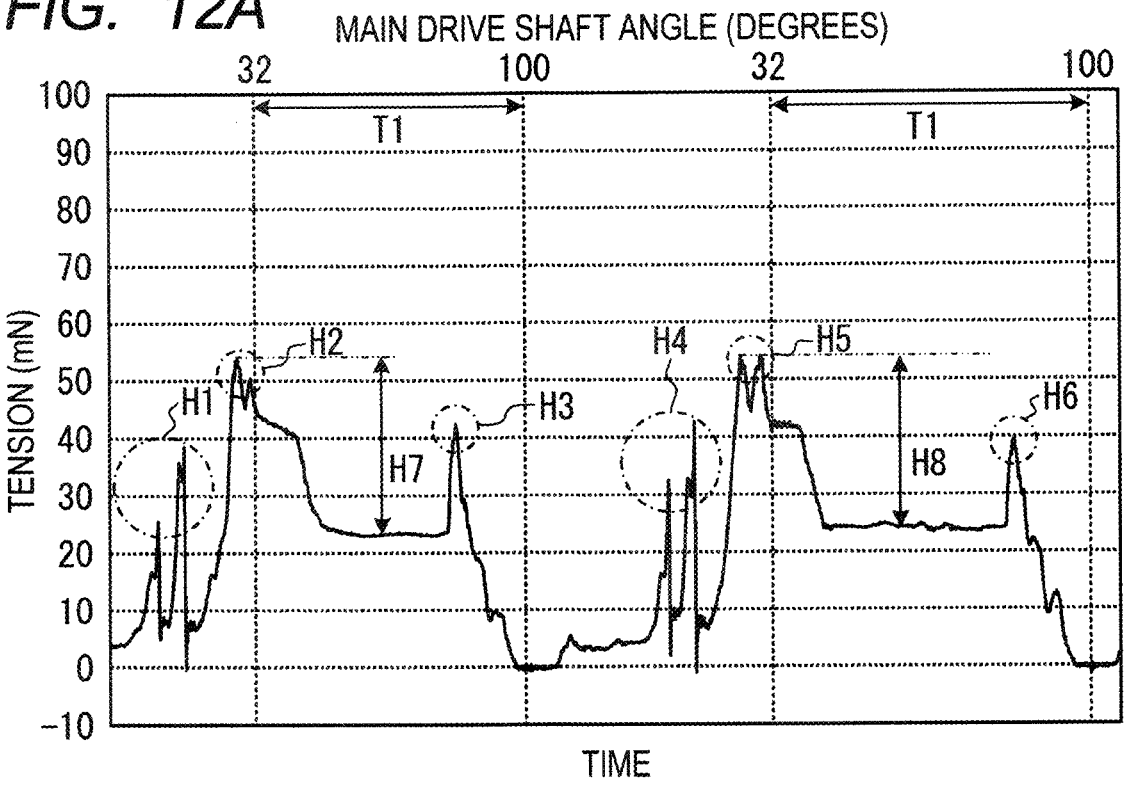
FIG. 12A is a graph showing a relationship between an elapsed time and a thread tension pressure.
Figure 12B:
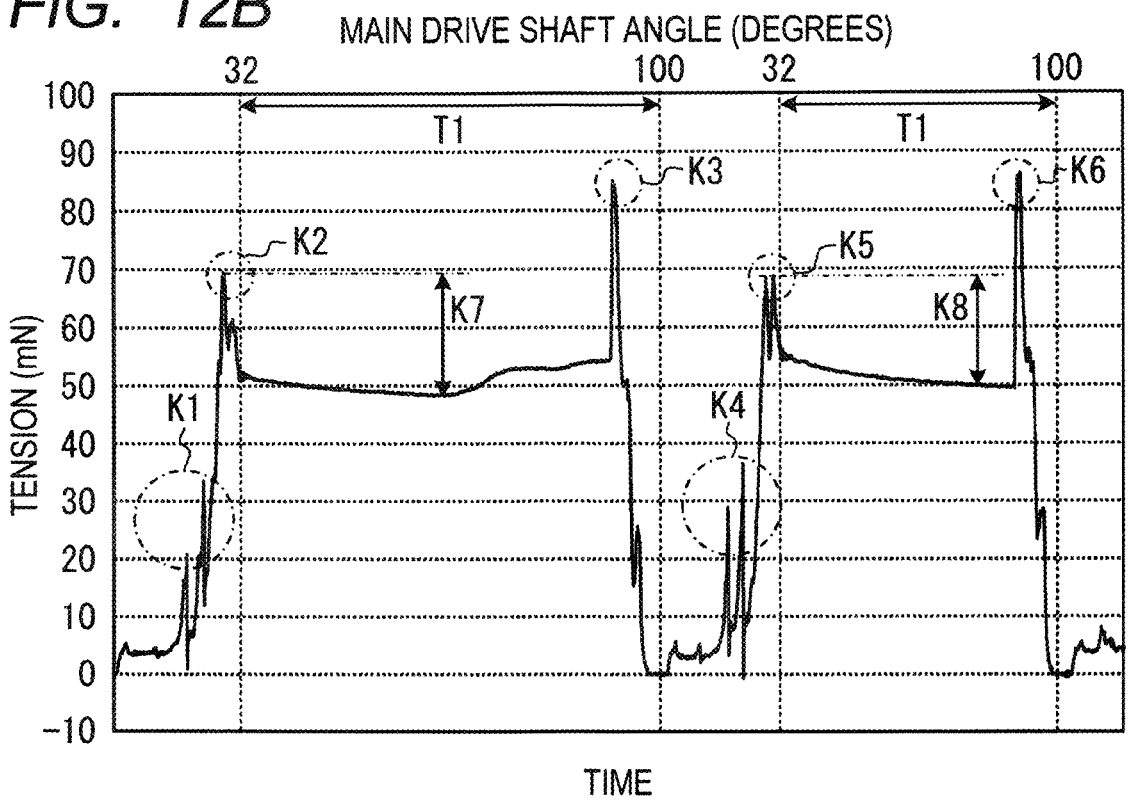
FIG. 12B is a graph showing a relationship between an elapsed time and a thread tension pressure.

Referring to FIGS. 12A and 12B, an evaluation test will be described. The evaluation test was conducted under the condition that the sewing machine 1 sets the spring length to the second length L2 based on the detection result of the movement detector 9 and that the presser foot 25 including the O-shaped insertion portion in plan view is attached. In the evaluation test, a case in which the sewing machine 1 performs free motion sewing without performing the thread tension adjustment process was used as a comparative example. In the evaluation test, a case in which the sewing machine 1 performs the above-described main process was used as an embodiment. FIGS. 12A and 12B show changes over time of the tension of the upper thread U when free motion sewing for two stitches is performed in the basting mode. The movement speed of the sewing workpiece C in the comparative example and the embodiment were approximately the same. The tension of the upper thread U was measured using DT series which is a known standard digital tension meter for hand use, manufactured by SCHMIDT. As shown in FIGS. 12A and 12B, the rotation angle of the main drive shaft 34 relative to the change over time is shown on the upper axis as a reference, but the amount of change of the rotation angle of the main drive shaft 34 on the graph is not constant since the sewing machine motor 33 stops when the rotation angle of the main drive shaft 34 is 32 degrees and the target value of the rotation speed of the sewing machine motor 33 is changed to the first speed and the second speed.

As shown in FIG. 12B, in the comparative example, tension peaks K1 and K4 are peaks during the hook catch period. Tension peaks K2 and K5 are peaks during the take-up lever pull-up period before stopping at the stop position. Tension peaks K3 and K6 are peaks during the take-up lever pull-up period after sewing is stopped at the stop position and then sewing is resumed.

Between the peak K2 and the peak K3, the tension decreases from the peak K2 by an amount of change K7. The tension at the peak K3 is higher than that at the peak K2. Between the peak K5 and the peak K6, the tension decreases from the peak K5 by an amount of change K8. The tension at the peak K6 is higher than that at the peak K5.

As shown in FIG. 12A, in the embodiment, tension peaks H1 and H4 are peaks during the hook catch period. Tension peaks H2 and H5 are peaks during the take-up lever pull-up period before stopping at the stop position. Tension peaks H3 and H6 are peaks during the take-up lever pull-up period after sewing is stopped at the stop position and then sewing is resumed.

Between the peak H2 and the peak H3, the tension decreases from the peak H2 by an amount of change H7. Between the peak H5 and the peak H6, the tension decreases from the peak H5 by an amount of change H8. The amounts of change H7 and H8 in the embodiment are larger than the amounts of change K7 and K8 in the comparative example. This is because the sewing machine 1 of the embodiment sets the spring length to the first length L1, the disc spacing to the first spacing E1, and the thread tension pressure to the first pressure during the first period T1, and thus the pressure applied to the upper thread U during a period in which sewing is stopped at the stop position is lower than that during the second period T2. Thus, the maneuverability of the sewing workpiece C when moving the upper thread U while manipulating the sewing workpiece C in the sewing machine 1 according to the embodiment was better than the maneuverability of the sewing workpiece C when moving the upper thread U while manipulating the sewing workpiece C in the sewing machine 1 according to the comparative example.

The tension at the peak H3 is smaller than the tension at the peak H2. The tension at the peak H6 is smaller than the tension in at the peak H5. The peaks H3 and H6 are seen during a period when the spring length is set to the first length L1. At the peaks H3 and H6, although the second thread tension disc 22 does not apply the thread tension pressure of the spring 23 to the upper thread U, it was confirmed that sufficient tension was applied to form stitches. There was no significant difference in the finish of the stitches formed in the embodiment and in the comparative example. From the above, it was confirmed that the maneuverability improves when the user manually moves the sewing workpiece C by performing the thread tension adjustment process during free motion sewing.

In the above-described embodiment, the sewing machine 1 is an example of a sewing machine of the present disclosure. The controller 3 is an example of a controller (processor) of the present disclosure. The movement detector 9 is an example of a movement detector of the present disclosure. The needle bar 15 is an example of a needle bar of the present disclosure. The presser bar 16 is an example of a presser bar of the present disclosure. The sewing needle 17 is an example of a sewing needle of the present disclosure. The sewing machine motor 33 is an example of a sewing machine motor of the present disclosure. The needle plate 41 is an example of a needle plate of the present disclosure. The first thread tension disc 21 is an example of a first thread tension disc of the present disclosure. The second thread tension disc 22 is an example of a thread tension disc and a second thread tension disc of the present disclosure. The actuator 36 is an example of an actuator of the present disclosure. The presser foot 25, 81 is an example of a presser foot of the present disclosure. The insertion portions 76 and 86 are examples of an insertion portion of the present disclosure. The spring 23 is an example of a spring of the present disclosure. The processing of S32, S35, S39, S42, S43, S45, S47 and S48 is an example of a free motion sewing operation of the present disclosure. The processing of S41, S46, S49, and S50 is an example of a thread tension adjustment process of the present disclosure. The processing of S47 and S48 is an example of a one stitch stopping process of the present disclosure. The processing of S19 is an example of a length adjustment process of the present disclosure.

The sewing machine 1 according to the embodiment described above includes the needle plate 41, the feed dog 32, the needle bar 15, the sewing machine motor 33, the second thread tension disc 22, the spring 23, the actuator 36, and the controller 3. The sewing needle 17 is attachable to the needle bar 15. The sewing machine motor 33 moves the needle bar 15 up and down. The spring 23 urges the second thread tension disc 22 to apply thread tension pressure to the second thread tension disc 22. The actuator 36 adjusts the length of the spring 23. The controller 3 performs the free motion sewing operation of moving the needle bar 15 up and down by driving the sewing machine motor 33 in a state where the upper end of the feed dog 32 is located below the needle plate 41 (S32, S35, S39, S42, S43, S45, S47, S48). The first period T1 is at least part of the needle up period TU, during which the lower end 18 of the sewing needle 17 is located above the needle plate 41. The second period T2 includes at least part of the needle down period TD, during which the lower end 18 of the sewing needle 17 is located below the needle plate 41. The controller 3 controls the actuator 36 to adjust the length of the spring 23 in the pressure direction J1 during the first period T1 to the first length L1 while performing the free motion sewing operation. The controller 3 performs the thread tension control operation of adjusting the length of the spring 23 in the pressure direction J1 during the second period T2 to the second length L2, which is shorter than the first length L1 (S41, S46, S49, S50). The thread tension control operation performed by the controller 3 of the sewing machine 1 includes adjusting the length of the spring 23 in the pressure direction J1 such that the second length L2 is shorter than the first length L1. With this configuration, the tension applied to the upper thread U during the first period T1 is smaller than the tension applied to the upper thread U during the second period T2. The first period T1 is a period during which the user may manually move the sewing workpiece C in the free motion sewing operation. Thus, the thread tension control operation contributes to improving the maneuverability of the sewing workpiece C when the user manually moves the sewing workpiece C.

The controller 3 performs the thread tension control operation in a case where an instruction to perform the thread tension control operation is detected (S1: YES) and does not perform the thread tension control operation in a case where the instruction to perform the thread tension control operation is not detected (S1: NO). The controller 3 of the sewing machine 1 contributes to switching between whether to perform the thread tension control operation during the free motion sewing operation, depending on whether the instruction to perform the thread tension control operation is detected.

The controller 3 performs the thread tension control operation in a case where basting is to be performed (S1: YES) and does not perform the thread tension control operation in a case where basting is not to be performed (S1: NO). In the case of basting, since the stitch length is longer than that in permanent sewing, the movement amount of the sewing workpiece C becomes large. Thus, in the case of basting, the thread extending from the stitches formed in the sewing workpiece C pulls the sewing workpiece C by a larger amount than the case of permanent sewing. The resistance caused by the movement of the sewing workpiece C is larger in the case of basting than in the case of permanent sewing. The controller 3 of the sewing machine 1 contributes to switching between whether to perform the thread tension control operation during the free motion sewing operation, depending on whether basting is to be performed.

The sewing machine 1 includes the movement detector 9 and the presser bar 16. The movement detector 9 detects the movement amount of the sewing workpiece C placed on the needle plate 41. The movement detector 9 is attachable to the presser bar 16. The controller 3 drives the sewing machine motor 33 (S32, S35, S39) based on the movement amount detected by the movement detector 9 in the free motion sewing operation (S32: YES). The controller 3 of the sewing machine 1 controls the sewing machine motor 33 based on the detection result output by the movement detector 9, thereby contributing to forming stitches of free motion sewing.

The controller 3 of the sewing machine 1 controls the sewing machine motor 33 to perform the one stitch stop operation of stopping the needle bar 15 for each stitch at the stop position at which the lower end 18 of the sewing needle 17 is above the needle plate 41 (S47, S48). The controller 3 controls the sewing machine motor 33 to sew one stitch when the movement amount detected by the movement detector 9 in the free motion sewing operation reaches a particular amount (S32: YES). The one stitch stop operation performed by the controller 3 of the sewing machine 1 contributes to ensuring sufficient time for the sewing workpiece C to move by stopping the needle bar 15 at the stop position each stitch. The one stitch stop operation contributes to improving the maneuverability of the sewing workpiece C when manually moving the sewing workpiece C during the needle up period TU, compared with the case where the needle bar 15 is not stopped at the stop position for each stitch.

The first period T1 includes the period during which the needle bar 15 is disposed at the stop position. In the thread tension control operation performed by the controller 3 of the sewing machine 1, the tension applied to the upper thread U is smaller during the first period T1, which includes the period during which the needle bar 15 is disposed at the stop position, than during the second period T2. Thus, the thread tension control operation contributes to improving the maneuverability of the sewing workpiece C when manually moving the sewing workpiece C while the needle bar 15 is stopped at the stop position.

The sewing machine 1 includes the presser foot having the insertion portion through which the sewing needle 17 is inserted. The controller 3 does not perform basting in a case where the presser foot includes a C-shaped insertion portion in plan view and performs basting in a case where the presser foot includes an O-shaped insertion portion in plan view. In a case where the presser foot includes the O-shaped insertion portion, the upper thread U is thread between the sewing needle 17 and the presser foot. In a case where the presser foot includes the C-shaped insertion portion, the upper thread U may not pass through the insertion portion of the presser foot depending on the distance and direction of movement of the sewing workpiece C, and the tension applied to the upper thread U is unstable, resulting that resistance is likely to be applied when the user moves the sewing workpiece C. The thread tension control operation contributes to avoiding unstable maneuverability of the sewing workpiece C when the sewing workpiece C is manually moved due to the fact that the sewing machine 1 is equipped with a presser foot that is prone to resistance from the upper thread U extending from the stitch when the sewing workpiece C is moved.

In a case where basting is not performed, the controller 3 performs the length adjustment process of adjusting the length of the spring 23 to the third length L3, which is shorter than the second length L2, while the free motion sewing operation is performed (S19). In a case where basting is not performed, for example, when performing permanent sewing, the controller 3 of the sewing machine 1 performs the thread tension adjustment process of forming stitches with a tension higher than that applied to the upper thread U during basting. In other words, the length adjustment process performed by the controller 3 of the sewing machine 1 contributes to stabilizing stitches in free motion sewing in a case where basting is not performed.

In a case where the movement amount detected by the movement detector 9 reaches a particular amount in the free motion sewing operation, the controller 3 drives the sewing machine motor 33 at a speed that allows the length of the spring 23 during the second period T2 to be adjusted to the second length L2. In a case where the moving speed of the sewing workpiece Cis relatively fast and the sewing machine motor 33 is driven at a speed that matches the moving speed of the sewing workpiece C, the process of adjusting the spring length from the first length L1 to the second length L2 may not be completed in time. In this case, there is a possibility that stitches are formed without appropriate tension being applied to the upper thread U. In contrast, in the free motion sewing operation performed by the controller 3 of the sewing machine 1, stitches are formed by giving priority to the thread tension control operation, rather than forming stitches at a speed that matches the movement amount of the sewing workpiece C. Thus, the free motion sewing operation performed by the sewing machine 1 contributes to avoiding forming stitches without appropriate tension being applied to the upper thread U.

In the free motion sewing operation, the controller 3 drives the sewing machine motor 33 to start the one stitch control process in a case where the length of the spring 23 is the first length L1. In a case where the moving speed of the sewing workpiece C is relatively fast and the sewing machine motor 33 is driven in accordance with the moving speed of the sewing workpiece C, the process of adjusting the spring length from the second length L2 to the first length L1 may not be completed in time. In this case, the sewing machine 1 may not be able to fully achieve the effect of improving maneuverability during the first period T1, which is a period in which the user may manually move the sewing workpiece C. In contrast, in the free motion sewing operation performed by the controller 3 of the sewing machine 1, stitches are formed by giving priority to the thread tension control operation, rather than forming stitches at a speed that matches the movement amount of the sewing workpiece C. Thus, the free motion sewing operation performed by the sewing machine 1 contributes to fully achieving the effect of improving maneuverability during the first period T1, which is a period in which the user may manually move the sewing workpiece C.

The actuator 36 of the sewing machine 1 adjusts the thread tension pressure applied to the second thread tension disc 22. The controller 3 performs the thread tension control operation of controlling the actuator 36 to adjust the thread tension pressure during the first period T1 to the first pressure and adjust the thread tension pressure during the second period T2 to the second pressure, which is higher than the first pressure. The thread tension control operation performed by the controller 3 of the sewing machine 1 adjusts the thread tension pressure such that the second pressure is higher than the first pressure. As a result of this thread tension pressure, the tension applied to the upper thread U during the first period T1 is smaller than the tension applied to the upper thread U during the second period T2. Thus, the thread tension control operation contributes to improving the maneuverability of the sewing workpiece C when the user moves the sewing workpiece C manually.

The actuator 36 of the sewing machine 1 adjusts the disc spacing between the first thread tension disc 21 and the second thread tension disc 22 to adjust the tension applied to the upper thread U disposed between the first thread tension disc 21 and the second thread tension disc 22. The controller 3 controls the actuator 36 during the free motion sewing operation to perform the thread tension control operation of adjusting the disc spacing during the first period T1 to the first spacing E1 and adjusting the disc spacing during the second period T2 to the second spacing E2, which is shorter than the first spacing E1. The thread tension control operation performed by the controller 3 of the sewing machine 1 adjusts the disc spacing such that the second spacing E2 is shorter than the first spacing E1. Thus, the tension applied to the upper thread U during the first period T1 is smaller than the tension applied to the upper thread U during the second period T2. Thus, the thread tension control operation contributes to improving the maneuverability of the sewing workpiece C when the user manually moves the sewing workpiece C.

While the disclosure has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the disclosure, and not limiting the disclosure. Various changes may be made without departing from the spirit and scope of the disclosure. Thus, the disclosure is intended to embrace all known or later developed alternatives, modifications, variations, improvements, and/or substantial equivalents. Some specific examples of potential alternatives, modifications, or variations in the described disclosure are provided below.

The present disclosure may be implemented in the form of a control method of a sewing machine, a sewing machine program, and a non-transitory computer-readable storage medium storing the sewing machine program. For example, the sewing machine 1 may be a sewing machine dedicated to sewing using the movement detector 9, and in this case, the feed-amount adjustment motor 30, the feed mechanism 31, and the feed dog 32 may be omitted.

The sewing machine 1 may include the movement detector 9, or the movement detector 9 may be omitted. The movement detector 9 detects the movement of the sewing workpiece C placed on the needle plate 41, and the configuration and shape of the movement detector 9 may be changed as appropriate, for example. The movement detector 9 may be built into the sewing machine 1. In this case, for example, a configuration corresponding to the movement detector 9 may be built in the bed 11 or the head 14.

The movement detector 9 may detect the movement of the sewing workpiece C (that is, whether the sewing workpiece C has moved), but the movement detector 9 may not detect the movement amount of the sewing workpiece C. The movement detector 9 may detect either one of the movement amount of the sewing workpiece C in the short direction D1 and the movement amount in the longitudinal direction D2. The movement detector 9 may detect the movement amount in any horizontal direction. The detection result of the movement detector 9 may indicate the movement amount of the sewing workpiece C and may not indicate the movement direction. The image sensor 8 may be omitted as appropriate.

The spring length may be represented by the length of the spring 23 in the pressure direction J1, or may be represented by the distance between the left end of the slider 26 and the right end of the plate member 39. The disc spacing may be measured in a state where the upper thread U is disposed between the first thread tension disc 21 and the second thread tension disc 22. The disc spacing may be measured in a state where the upper thread U is not disposed between the first thread tension disc 21 and the second thread tension disc 22. The change in the thread tension pressure may be measured, for example, by a change of the force of pulling out the upper thread U in a state where the upper thread U is disposed between the first thread tension disc 21 and the second thread tension disc 22.

The first thread tension disc 21 may be omitted from the thread tensioner 20. The arrangement of the thread tensioner 20 may be changed as appropriate, and for example, the thread tensioner 20 may be arranged in a posture in which the shaft 24 is oriented in the front-rear direction. The actuator 36 may be another actuator such as a servo motor, a linear motor, or a solenoid, instead of the pulse motor. The type of the spring 23 may be changed as appropriate. The spring 23 may directly contact the second thread tension disc 22. The mechanism that transmits the driving force of the actuator 36 to the spring 23 may be changed as appropriate in accordance with the type of the actuator 36 or the arrangement of the thread tensioner 20, for example. The first thread tension disc 21 and the second thread tension disc 22 may be a first roller and a second roller, respectively. In this case, the upper thread U may be held between the first roller and the second roller, and the upper thread U may be fed out by the rotation of the first roller and the second roller. The first thread tension disc 21 and the second thread tension disc 22 may be omitted as appropriate. In this case, the thread tension pressure may be transmitted to the upper thread U via a member other than the thread tension disc.

The various types of information may be input to the sewing machine 1 by a device and a method capable of inputting information to the controller 3. The input interface may be any device and method that allows information to be input to the controller 3, such as a keyboard, pointing devices such as a mouse, trackball, touchpad, and graphics tablet, a scanner, a touchscreen incorporated into the display, audio input devices such as voice recognition systems, and other types of input devices such as microphones.

The program including the instructions for performing the processing of FIGS. 8 to 10 may be stored in a memory of each apparatus by the time the controller 3 executes the program. Thus, the method of acquiring the program, the acquisition path, and the device that stores the program may be changed as appropriate. The program performed by the controller 3 may be received from another apparatus via a cable or wireless communication and stored in the memory. The other apparatuses include, for example, a PC and a server connected via a network.

The steps of the main process are not limited to the example of being performed by the controller 3, and some or all of the steps may be performed by another electronic device (for example, an ASIC). The steps of the main process may be processed in a distributed manner by a plurality of electronic devices (for example, a plurality of CPUs). The order of the steps of the main process may be changed, and steps may be omitted or added as appropriate. The following changes may be made to the main process as appropriate.

The method of acquiring the thickness of the sewing workpiece C may be changed as appropriate, and the controller 3 may dispose the presser bar 16 at the lowered position without acquiring the thickness of the sewing workpiece C. The lowered position and the normal position may be changed as appropriate. The lowered position may be a position where the presser foot 25 contacts the sewing workpiece C, or may be a position several millimeters above the position where the presser foot 25 contacts the sewing workpiece C. The first period T1, the second period T2, and the stop position may be changed as appropriate.

The instruction to perform the thread tension control operation may be changed as appropriate. The instruction used for determining whether to perform the thread tension control operation may be detected, for example, when the length of the stitch is larger than or equal to a particular value, or when the upper thread tension detected by the tension sensor is higher than or equal to a particular value, for example. The thread tension control operation may be performed in a mode other than the basting mode.

The thread tension control operation may be performed when the movement detector 9 is not attached to the presser bar 16. In this case, the free motion sewing operation may include controlling the sewing machine motor 33 at a speed instructed by a foot controller, for example, to sew one stitch. The controller 3 of the sewing machine 1 contributes to forming stitches by controlling the sewing machine motor 33 in accordance with the detection result output by the movement detector 9. The controller 3 may omit the one stitch stop operation and may continuously reciprocate the needle bar 15 in the upper-lower direction at a particular speed. In this case, since the needle bar 15 is not stopped at the stop position, the first period T1 does not need to include a period in which the needle bar 15 is disposed at the stop position.

The controller 3 may perform basting in a case where the presser foot includes a C-shaped insertion portion in plan view. The controller 3 may not perform basting in a case where the insertion portion of the presser foot has a particular shape in plan view other than an O-shape and a C-shape, such as a V-shape. In a case where the presser foot includes the insertion portion having an O-shape in plan view, the controller 3 may perform normal basting or permanent sewing in a state where the spring length, the disc spacing, and the thread tension pressure are constant. The stitch length in the normal basting is larger than the stitch length in the normal permanent sewing.

The controller 3 may detect the shape of the presser foot in plan view without using the neural network. For example a unique marker may be provided on each presser foot, and the controller 3 may detect the presser foot by reading the marker with the image sensor 8. The marker may be a two-dimensional code or a particular figure such as a star shape, for example. The controller 3 may determine the shape of the presser foot in plan view based on image data generated by the image sensor 8 or based on information input by the user via the input interface. The controller 3 may determine the shape of the presser foot in plan view based on information of an RFID attached to the presser foot obtained from information read by a reader. In a case where the movement detector 9 includes a sensor that mechanically detects the type of the presser foot, the controller 3 may determine the shape of the presser foot in plan view based on information output from the movement detector 9.

The sewing machine 1 may be configured such that one type of presser foot is attachable to the sewing machine 1. The sewing machine 1 may perform the thread tension control operation regardless of the type of presser foot.

The method of determining the spring length, the disc spacing, and the thread tension pressure may be changed as appropriate. The sewing machine 1 may omit the thread tension sensor 37. The controller 3 may determine the spring length, the disc spacing, and the thread tension pressure based on an output value to the actuator 36. The controller 3 may specify the spring length, the disc spacing, and the thread tension pressure based on an output value of the encoder that detects the drive amount of the actuator 36.

Each of the spring length, the disc spacing, and the thread tension pressure during sewing slightly fluctuates due to vibration caused by sewing, for example. Thus, the spring length, the disc spacing, and the thread tension pressure in each of the first period and the second period do not need to be strictly constant, and may vary. The difference between the first length L1 and the second length L2 may be sufficiently large compared to a minute fluctuation caused by vibration of the spring length, for example. The difference between the first spacing E1 and the second spacing E2 may be sufficiently larger than a minute fluctuation caused by vibration of the disc spacing, for example. The difference between the first pressure and the second pressure may be sufficiently larger than a minute fluctuation caused by vibration of the thread tension pressure, for example. Similarly, the difference between the second length L2 and the third length L3 may be sufficiently large compared to the minute fluctuation of the spring length due to vibration, for example. The first spacing E1 may not be a spacing sufficiently larger than the thickness of the upper thread U, and may be a spacing larger than 1.0 times and smaller than or equal to 1.2 times the thickness of the upper thread U, for example.

The controller 3 may adjust the length of the spring 23 in the pressure direction J1 to a length larger than or equal to the second length L2 during the free motion sewing operation when basting is not performed. When the movement amount detected by the movement detector 9 reaches a particular amount in the free motion sewing operation, the controller 3 may control the sewing machine motor 33 at a speed higher than a speed at which the length of the spring 23 in the pressure direction J1 during the second period T2 is adjustable to the second length L2, and sew one stitch. The controller 3 may drive the sewing machine motor 33 to start sewing one stitch in a state where the spring length is not the first length. In the free motion sewing operation, the controller 3 may determine whether the movement amount detected by the movement detector 9 has reached the particular amount during the needle down period TD.

The above modifications may be combined as appropriate as long as no contradiction occurs. The applicant of the present application has an intention to acquire patent rights for aspects combined with each other within a range not departing from the scope of the present disclosure and not causing contradiction, in addition to the combinations exemplified in the claims.

What is claimed is:

1. A sewing machine comprising:

a needle plate;

a feed dog;

a needle bar to which a sewing needle is attachable;

a sewing machine motor configured to drive the needle bar to move up and down;

a thread tension disc;

a spring configured to urge the thread tension disc to apply a thread tension pressure to the thread tension disc;

an actuator configured to adjust a length of the spring; and a controller configured to:

perform a free motion sewing operation of driving the sewing machine motor to move the needle bar up and down in a state where an upper end of the feed dog is located below the needle plate; and perform a thread tension control operation of, while performing the free motion sewing operation, controlling the actuator to adjust the length of the spring during a first period to a first length and to adjust the length of the spring during a second period to a second length shorter than the first length, the first period being at least part of a needle up period in which a lower end of the sewing needle is located above the needle plate, the second period including at least part of a needle down period in which the lower end of the sewing needle is located below the needle plate.

2. The sewing machine according to claim 1, wherein the controller is configured to:

in response to detecting an instruction to perform the thread tension control operation, perform the thread tension control operation; and in response to not detecting the instruction to perform the thread tension control operation, not perform the thread tension control operation.

3. The sewing machine according to claim 1, wherein the controller is configured to:

in a case where the controller detects an instruction to select a basting mode, perform the thread tension control operation; and in a case where the controller does not detect the instruction to select the basting mode, not perform the thread tension control operation.

4. The sewing machine according to claim 3, further comprising:

a movement detector configured to detect a movement amount of a sewing workpiece placed on the needle plate; and a presser bar to which the movement detector is attachable, wherein the controller is configured to:

in the free motion sewing operation, drive the sewing machine motor based on the movement amount detected by the movement detector.

5. The sewing machine according to claim 4, wherein the controller is configured to:

perform a one stitch stop operation of controlling the sewing machine motor to stop the needle bar at a stop position each time one stitch is sewn, the stop position being a position where the lower end of the sewing needle is located above the needle plate; and in the free motion sewing operation, in a case where the movement amount detected by the movement detector reaches a particular amount, drive the sewing machine motor to start sewing one stitch.

6. The sewing machine according to claim 5, wherein the first period includes a period in which the needle bar is disposed at the stop position.

7. The sewing machine according to claim 5, wherein the controller is configured to:

in the free motion sewing operation, in the case where the movement amount detected by the movement detector reaches the particular amount, drive the sewing machine motor at such a speed that a length of the spring during the second period is adjustable to the second length.

8. The sewing machine according to claim 5, wherein the controller is configured to:

in the free motion sewing operation, drive the sewing machine motor to start sewing one stitch in a state where the length of the spring is the first length.

9. The sewing machine according to claim 3, further comprising:

a presser foot including an insertion portion configured that the sewing needle is inserted through the insertion portion, wherein the controller is configured to:

not perform the basting mode in a case where the insertion portion has a C-shape in plan view; and perform the basting mode in a case where the insertion portion has an O-shape in plan view.

10. The sewing machine according to claim 3, wherein the controller is configured to:

in the case where the controller does not detect the instruction to select the basting mode, adjust the length of the spring to a third length, the third length being shorter than the second length.

11. The sewing machine according to claim 1, further comprising:

a movement detector configured to detect a movement amount of a sewing workpiece placed on the needle plate, wherein the controller is configured to:

in response to determining that a cumulative value of the movement amount exceeds a particular amount, perform a one stitch sewing operation including:

adjusting the length of the spring to the second length;

driving the sewing machine motor to sew one stitch;

stopping the sewing machine motor at a stop position where the lower end of the sewing needle is above the needle plate; and adjusting the length of the spring to the first length.

12. A sewing machine comprising:

a needle plate;

a feed dog;

a needle bar to which a sewing needle is attachable;

a sewing machine motor configured to drive the needle bar to move up and down;

an actuator configured to adjust a thread tension pressure for adjusting a tension applied to an upper thread; and a controller configured to:

perform a free motion sewing operation of driving the sewing machine motor to move the needle bar up and down in a state where an upper end of the feed dog is located below the needle plate; and perform a thread tension control operation of, while performing the free motion sewing operation, controlling the actuator to adjust the thread tension pressure during a first period to a first pressure and to adjust the thread tension pressure during a second period to a second pressure higher than the first pressure, the first period being at least part of a needle up period in which a lower end of the sewing needle is located above the needle plate, the second period including at least part of a needle down period in which the lower end of the sewing needle is located below the needle plate.

13. A sewing machine comprising:

a needle plate;

a feed dog;

a needle bar to which a sewing needle is attachable;

a sewing machine motor configured to drive the needle bar to move up and down;

a first thread tension disc;

a second thread tension disc;

an actuator configured to adjust a disc spacing between the first thread tension disc and the second thread tension disc to adjust a tension applied to an upper thread disposed between the first thread tension disc and the second thread tension disc; and a controller configured to:

perform a free motion sewing operation of driving the sewing machine motor to move the needle bar up and down in a state where an upper end of the feed dog is located below the needle plate; and perform a thread tension control operation of, while performing the free motion sewing operation, controlling the actuator to adjust the disc spacing during a first period to a first spacing and to adjust the disc spacing during a second period to a second spacing smaller than the first spacing, the first period being at least part of a needle up period in which a lower end of the sewing needle is located above the needle plate, the second period including at least part of a needle down period in which the lower end of the sewing needle is located below the needle plate.

* * * * *